US012644250B2

(12) United States Patent
Mecklin et al.

(10) Patent No.: US 12,644,250 B2
(45) Date of Patent: Jun. 2, 2026

(54) LOADER COUPLER WITH VISUAL LOCKING INDICATOR

(71) Applicant: Paladin Brands Group, Inc., New Britain, CT (US)

(72) Inventors: Matthew G. Mecklin, Two Harbors, MN (US); Nicholas D. Comyn, New Westminster (CA)

(73) Assignee: Paladin Brands Group, Inc., Delhi, IA (US)

( * ) Notice: Subject to any disclaimer, the term of this patent is extended or adjusted under 35 U.S.C. 154(b) by 491 days.

(21) Appl. No.: 18/315,912

(22) Filed: May 11, 2023

(65) Prior Publication Data

US 2024/0376686 A1 Nov. 14, 2024

(51) Int. Cl.
*E02F 3/36* (2006.01)
*E02F 9/22* (2006.01)
*E02F 9/26* (2006.01)

(52) U.S. Cl.
CPC ..... *E02F 3/3663* (2013.01); *E02F 9/2225* (2013.01); *E02F 9/26* (2013.01)

(58) Field of Classification Search
CPC ..... E02F 3/3663; E02F 3/3604; E02F 3/3609; E02F 3/364; E02F 3/3622; E02F 3/3631; E02F 3/3636; E02F 9/2225; E02F 9/26
See application file for complete search history.

(56) References Cited

U.S. PATENT DOCUMENTS 4,708,579 A 11/1987 Baird et al.
5,010,962 A 4/1991 Bloom, Jr.
5,529,419 A 6/1996 Gebauer
5,692,855 A 12/1997 Burton
6,301,811 B1 * 10/2001 Gilmore, Jr. ..... E02F 3/3654 37/468
6,860,706 B2 3/2005 Godwin et al.
7,686,532 B2 3/2010 Kimble
7,984,576 B2 7/2011 Miller et al.
(Continued)

FOREIGN PATENT DOCUMENTS

CA 3065730 A1 6/2021
CA 3150811 A1 9/2022
(Continued)

*Primary Examiner* — Joseph M Rocca
*Assistant Examiner* — Robert E Pezzuto
(74) *Attorney, Agent, or Firm* — Nyemaster Goode, P.C.

(57) ABSTRACT

A coupler assembly having a hydraulic system configured to move locking pins between an extended position where the locking pins are received by lugs in an implement to secure the coupler assembly to the implement, and a retracted position wherein the locking pins are retracted from the lugs to allow the implement to be removed from the coupler assembly. The coupler assembly includes a proximity sensor configured to determine whether the implement is seated properly with the coupler assembly. The proximity sensor is in communication with the coupler's hydraulic system and only allows the flow of hydraulic fluid through the system toward the locking pins when the implement is determined to be properly seated with the coupler. The coupler assembly further includes an indicator in communication with the coupler's hydraulic system and configured to visually indicate whether the implement meets certain conditions to indicate a proper attachment.

23 Claims, 22 Drawing Sheets

(56) References Cited

U.S. PATENT DOCUMENTS

| | | | |
|---|---|---|---|
| 8,256,148 | B2 | 9/2012 | Miller et al. |
| 8,448,357 | B2 | 5/2013 | Miller et al. |
| 8,800,179 | B2 | 8/2014 | Seda et al. |
| 9,322,145 | B2 | 4/2016 | Nilsson et al. |
| 9,574,319 | B2 | 2/2017 | Seljestad |
| 10,590,631 | B2 | 3/2020 | Keighley et al. |
| 10,711,429 | B2 | 7/2020 | Webb et al. |
| 11,482,083 | B2 | 10/2022 | Kollmann |
| 11,643,787 | B2 | 5/2023 | Anderson et al. |
| 2015/0233084 | A1 | 8/2015 | Seljestad |
| 2016/0237656 | A1* | 8/2016 | Doherty ..... E02F 3/3618 |
| 2019/0127954 | A1 | 5/2019 | Erhardt et al. |
| 2021/0123211 | A1 | 4/2021 | Miller et al. |
| 2021/0270008 | A1 | 9/2021 | Loisy et al. |
| 2022/0034061 | A1 | 2/2022 | Walthers et al. |

FOREIGN PATENT DOCUMENTS

| | | | |
|---|---|---|---|
| CN | 112292492 | A | 1/2021 |
| CN | 112292492 | B | 6/2022 |
| EP | 3770330 | A1 | 1/2021 |
| EP | 3814578 | A1 | 5/2021 |
| EP | 4060124 | A1 | 9/2022 |
| EP | 4089236 | A1 | 11/2022 |

* cited by examiner

LOADER COUPLER WITH VISUAL LOCKING INDICATOR

BACKGROUND

The invention generally relates to couplings of the type used to mount detachable farm or construction implements on the free end of the arms of a prime mover vehicle such as a tractor, loader, or the like.

Loaders are powered vehicles running on wheels or tracks having hydraulically operated upper and lower pairs of arms extending from the front of the vehicle. Loader machines such as front-end loaders and tractor-loaders (each of which is sometimes referred to herein generally as a "loader") often include a quick coupler operatively connected to the arms. The coupler is adapted to mate selectively and releasably with an implement for performing work, such as a construction attachment or agricultural attachment (e.g., a bucket, a boom, a fork attachment, a rake, or the like). Such coupler systems typically use a male master mounted on the upper and lower arms of the loader together with female coupler attachments affixed to an implement. The implement typically consists of a pair of upper hooks and lower protruding lugs. The upper hooks receive a generally horizontal male member on the coupler. The lower protruding lugs have slots or openings which are configured to receive movable locking wedges or pins combined with the coupler (as used herein "locking pins" shall include locking wedges and other suitably shaped locking members). The implement is secured or released by extension or retraction of hydraulically or manually actuated locking pins through the protruding lugs. To be properly connected, both upper hooks need to be fully around the upper horizontal bar member of the coupler and both locking pins need to be extended through the respective implement lugs of the implement. The coupler allows an operator of the loader to engage with and disengage from various implements as needed without exiting the operator's cab. Such couplers provide for improved machine productivity and operator convenience as compared conventional loaders that require the operator to exit the cab to connect and disconnect each implement. An exemplary coupler is disclosed in U.S. Pat. No. 4,708,579 (Baird et al.) issued on Nov. 24, 1987, the complete disclosure is hereby incorporated by this reference.

Prior couplers of the above type are disadvantageous in that there are no means of signaling the operator whether the locking pins are fully latched to the implement. In some cases, the coupling may approach the implement but, for one reason or another, the locking pins may not move fully into latching engagement with the implement. For example, the lug on the implement may be dirty or bent and therefore incapable of fully receiving the coupler's pin. Further, even if fully extended, the lug/pin engagement may occur at a location that is difficult for the operator to see from the cab. Accordingly, the operator must leave the prime mover vehicle and visually inspect the pins to make certain that the implement is securely attached. Still further, it is important to ensure the implement remains properly attached to the coupler during use. Damage to hydraulic lines, valves, and motors, leaking hydraulic fluid, and external forces acting on the locking pins during operation can all cause the locking pins to retract from an extended position to an unsafe position without warning to the operator.

There is therefore a need for an improved coupler which overcomes these and other drawbacks in the prior art.

SUMMARY

One aspect of the present disclosure relates to a coupler assembly for coupling an implement to a prime mover vehicle. The coupler assembly includes a hydraulic system having a first fluid flow path and a second fluid flow path. The hydraulic system is configured to convey fluid under system pressure to a hydraulic cylinder for moving one or more locking pins between an extended position and a retracted position. A proximity sensor is in communication with the hydraulic system, the proximity sensor having an open position wherein system pressure is allowed to flow through the first fluid flow path toward the hydraulic cylinder and a closed position wherein fluid is prevented from flowing through the first fluid flow path toward the hydraulic cylinder. An indicator in communication with the hydraulic system through a third fluid flow path, the indicator is configured to indicate a first sign when system pressure is not received through the third fluid flow path and a second sign when system pressure is received through the third fluid flow path. The first sign is indicative of the locking pins not being in the extended position and the second sign is indicative of the locking pins being in the extended position.

Another aspect of the present disclosure relates to a coupler assembly configured to selectively couple a work implement to a prime mover vehicle. The coupler assembly includes a hydraulic system configured to convey hydraulic fluid under system pressure from a hydraulic motor or other source to move one or more locking pins between an extended position where the locking pins are received by openings or lugs in the work implement to secure the coupler assembly to the implement, and a retracted position wherein the locking pins are retracted from the openings or lugs to allow the implement to be removed from the coupler assembly. The hydraulic system of the coupler assembly is configured to be combined with and operated by the hydraulic system of a prime mover vehicle. In some embodiments the locking pins are the rod of a hydraulic cylinder. In other embodiments the locking pins are actuated by the rod of a hydraulic cylinder. The coupler assembly further includes one or more proximity sensors configured to determine whether the implement is seated properly with the coupler assembly. The proximity sensors are in communication with the coupler's hydraulic system and only allow the flow of hydraulic fluid through the system toward the locking pins when the implement is determined to be properly seated with the coupler. The coupler assembly further includes an indicator in communication with the coupler's hydraulic system. The indicator may be a visual indicator configured to visually indicate a first sign and a second sign. The first sign is indicative of the implement not being properly attached to the coupler and the second sign is indicative of the implement being properly attached to the coupler. In some embodiments the indicator physically moves between a first position to indicate the first sign and a second position to indicate the second sign, and is biased in the first position by a biasing member such as a spring. The indicator is biased in the first position and is only moved to the second position if certain conditions are met. In some embodiments, in order for the indicator to be moved to the second position signaling a proper attachment, the proximity sensor(s) must be actuated to allow fluid to flow through the hydraulic system to the locking pins and the locking pins must be fully extended. In some embodiment, if these conditions are met, then hydraulic fluid is conveyed through a fluid flow path to the indicator at a high enough system pressure to overcome the biasing force keeping the indicator in the first position, thereby moving the indicator to the second position. In other embodiments other conditions are also required to convey enough hydraulic pressure to move the indicator to the second position.

Another aspect of the present disclosure relates to a hydraulic system associated with a coupler assembly configured to selectively attach to a work implement. The hydraulic system associated with a coupler assembly is configured to be combined with and operated by the hydraulic system of a prime mover vehicle. The hydraulic system of the coupler assembly is configured to convey system pressure from the hydraulic system of a prime mover vehicle to move one or more locking pins between an extended position where the locking pins are received by openings or lugs in the work implement to secure the coupler assembly to the implement, and a retracted position wherein the locking pins are retracted from the openings or lugs to allow the implement to be removed from the coupler assembly. The hydraulic system of the coupler assembly includes one or more proximity sensors configured to determine whether the implement is seated properly with the coupler assembly. The proximity sensors are in communication with the coupler's hydraulic system and only allow the flow of hydraulic fluid through the system toward the locking pins when the implement is determined to be properly seated with the coupler. Each proximity sensor includes a permissive control valve that, in some embodiments, is plunger operated such that the implement provides force against the plunger when the implement is properly seated against the coupler. The permissive control valve is biased in a first position wherein fluid is not allowed to move through the hydraulic system toward the one or more locking pins. The force from the properly seated implement actuates the plunger to move the permissive control valve into a second position where hydraulic fluid is allowed to move in the hydraulic system toward the one or more locking pins. The hydraulic system of the coupler assembly further includes a fluid pathway from the one or more locking pins to an indicator, which may be a visual indicator, configured to move between a first position having a first sign or signal and a second position having a second sign or signal. The first position is indicative of the implement not being properly attached to the coupler and the second position is indicative of the implement being properly attached to the coupler. The indicator is biased in the first position by a biasing member such as a spring and is only moved to the second position if certain conditions are met which allow hydraulic system pressure to overcome the biasing force thereby moving the indicator to the second position indicating proper attachment with the implement. In some embodiments, in order for the indicator to be moved to the second position signaling a proper attachment, the proximity sensors must be actuated to allow fluid to flow through the hydraulic system to the locking pins and the locking pins must be extended, which opens a fluid pathway allowing system pressure to flow to the indicator. In other embodiments other conditions are also required to provide enough hydraulic pressure to move the indicator to the second position.

Another aspect of the present disclosure relates to a method for determining a state of a coupler assembly. The method includes providing a coupler assembly having a hydraulic system, as described above, the coupler assembly configured to be selectively attached to an implement. Connecting the hydraulic system of the coupler to the hydraulic system of the prime mover vehicle and attempting to attach the implement to the coupler. Actuating system pressure to move the locking pins to the extended position. In the event the implement is properly seated with the coupler, the proximity sensors allowing fluid to flow through the hydraulic system toward the locking pins thereby meeting a first condition. In the event the implement is not properly seated with the coupler, the proximity sensors preventing fluid from flowing through the hydraulic system toward the locking pins and the indicator remaining in the first position without meeting the first condition. Upon meeting the first condition, fluid pressure is conveyed through the system to extend the locking pins to the extended position. In the event the locking pins extend to the extended position, a second condition is met and hydraulic system pressure overcomes the biasing force keeping the indicator in the first position thereby moving the indicator to the second position indicating the implement has been properly attached to the coupler assembly. In the event the locking pins do not extend to the extended position, the second condition is not met and the indicator remains in the first position. Actuating system pressure to move the locking pins to the retracted position thereby causing the biasing force of the indicator to be greater than retraction system pressure so the indicator returns to the first position.

DETAILED DESCRIPTION

Figure 1:
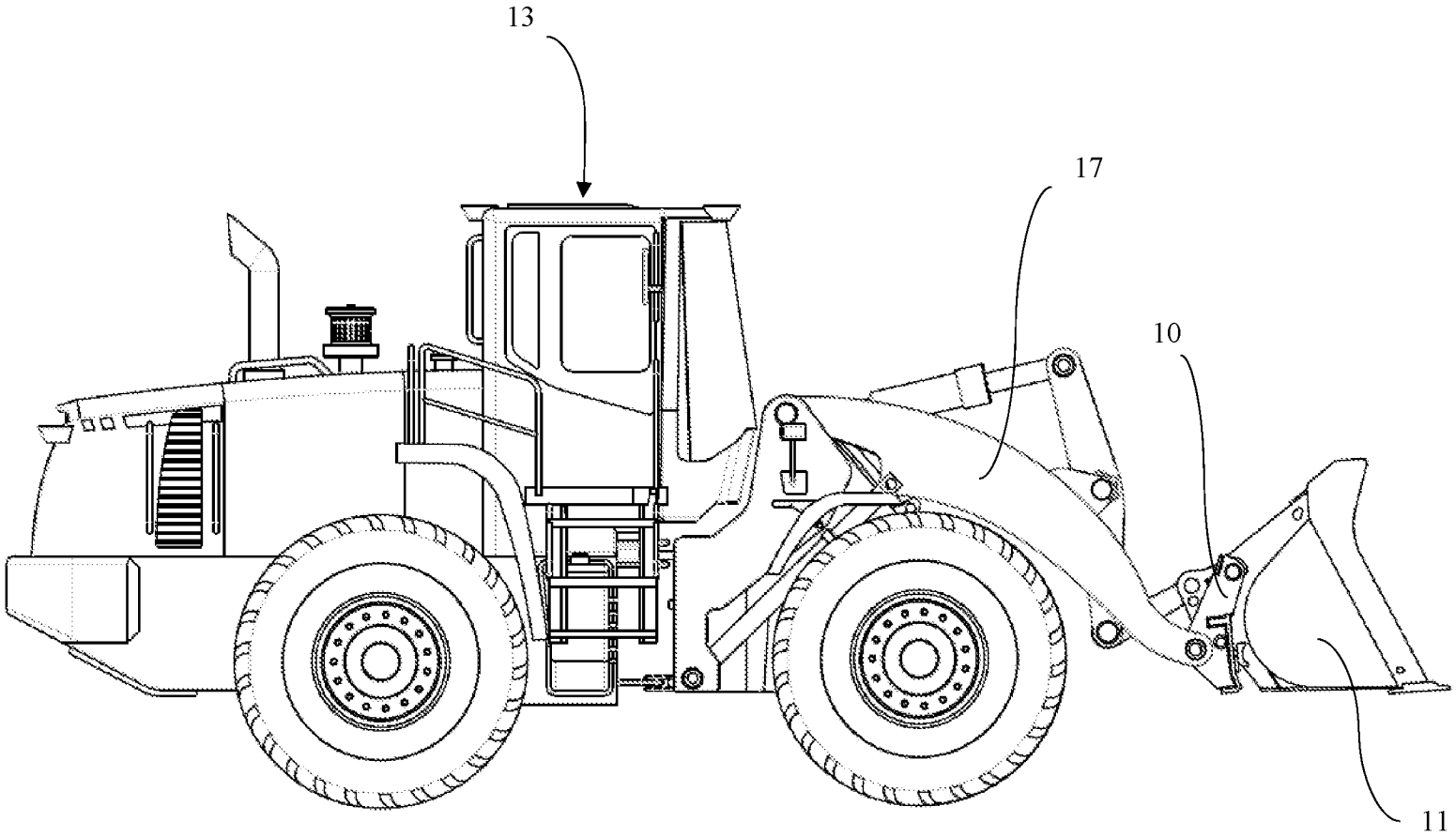
FIG. 1 is a side view of a prime mover vehicle using an embodiment of the coupler assembly to attach to an implement.

The invention generally relates to a coupler assembly 10 having a hydraulic system 50 configured to actuate an indicator 16 upon the occurrence of certain conditions. The hydraulic system 50 of the coupler assembly 10 is configured to be fluidly connected to and operated by the hydraulic system of a prime mover vehicle 13. The hydraulic system 50 of the coupler assembly 10 is configured to convey a fluid, which may be a hydraulic fluid, from the hydraulic system of the prime mover vehicle 13 to a hydraulic cylinder 19 and other system components described herein. The fluid is conveyed into the hydraulic system 50 of the coupler assembly 10 under system pressure and is conveyed back to the hydraulic system of the prime mover vehicle 13 under return system pressure. The hydraulic system described herein will primarily relate to the hydraulic system 50 of the coupler assembly 10. Further, reference is primarily made to "hydraulic" fluid, however, any other suitable fluid may be used with the system.

Figure 2:
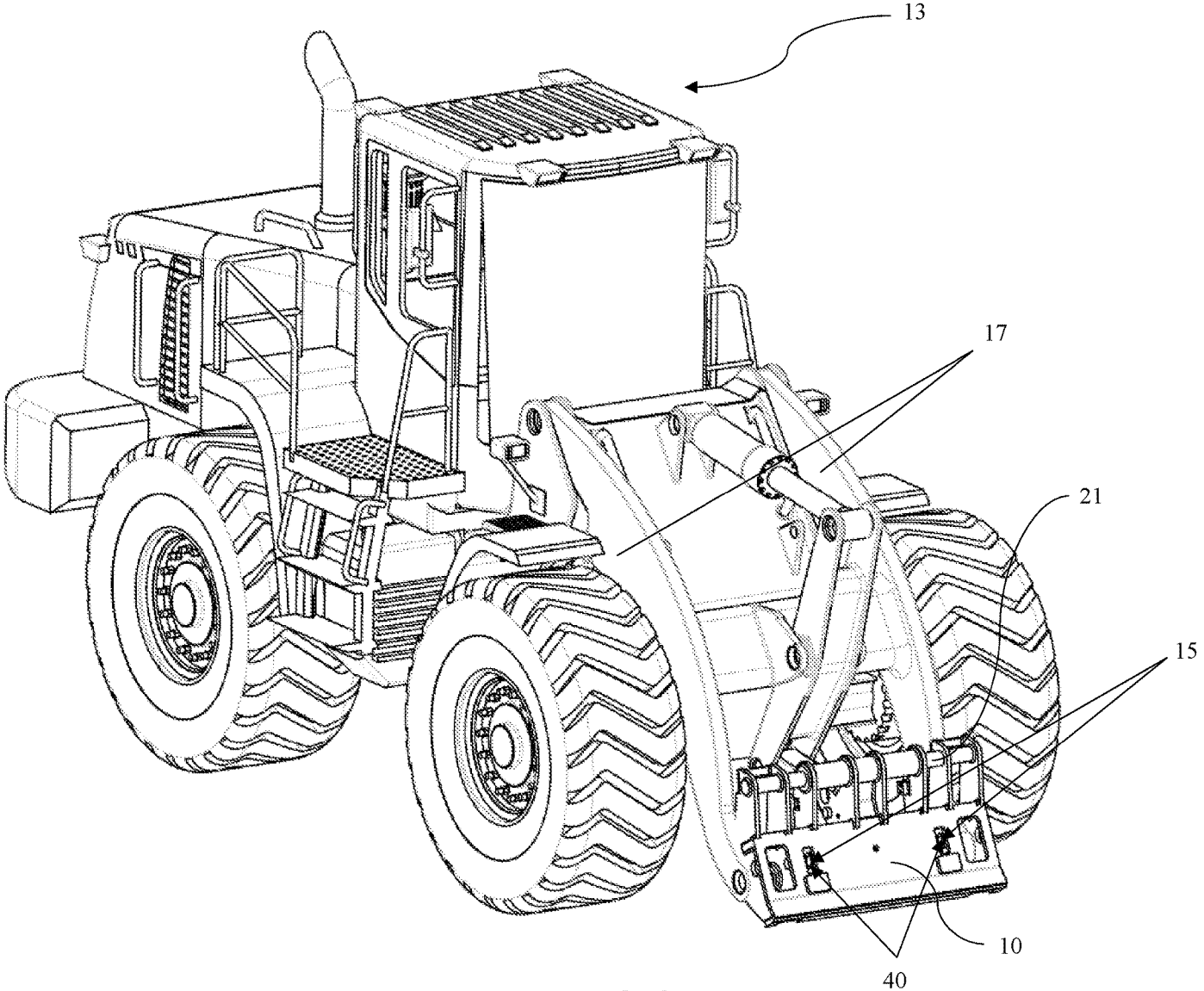
FIG. 2 is a front perspective view of a prime mover combined with an embodiment of the coupler assembly without an implement attached.

FIGS. 1 and 2 generally show the coupler assembly 10 attached to the arms 17 of a prime mover vehicle 13. FIG. 1 shows the coupler assembly 10 further attached to an implement 11. As shown, the implement 11 is a bucket, however, any suitable implement 11 may be attached to the coupler assembly 10.

Figure 3:
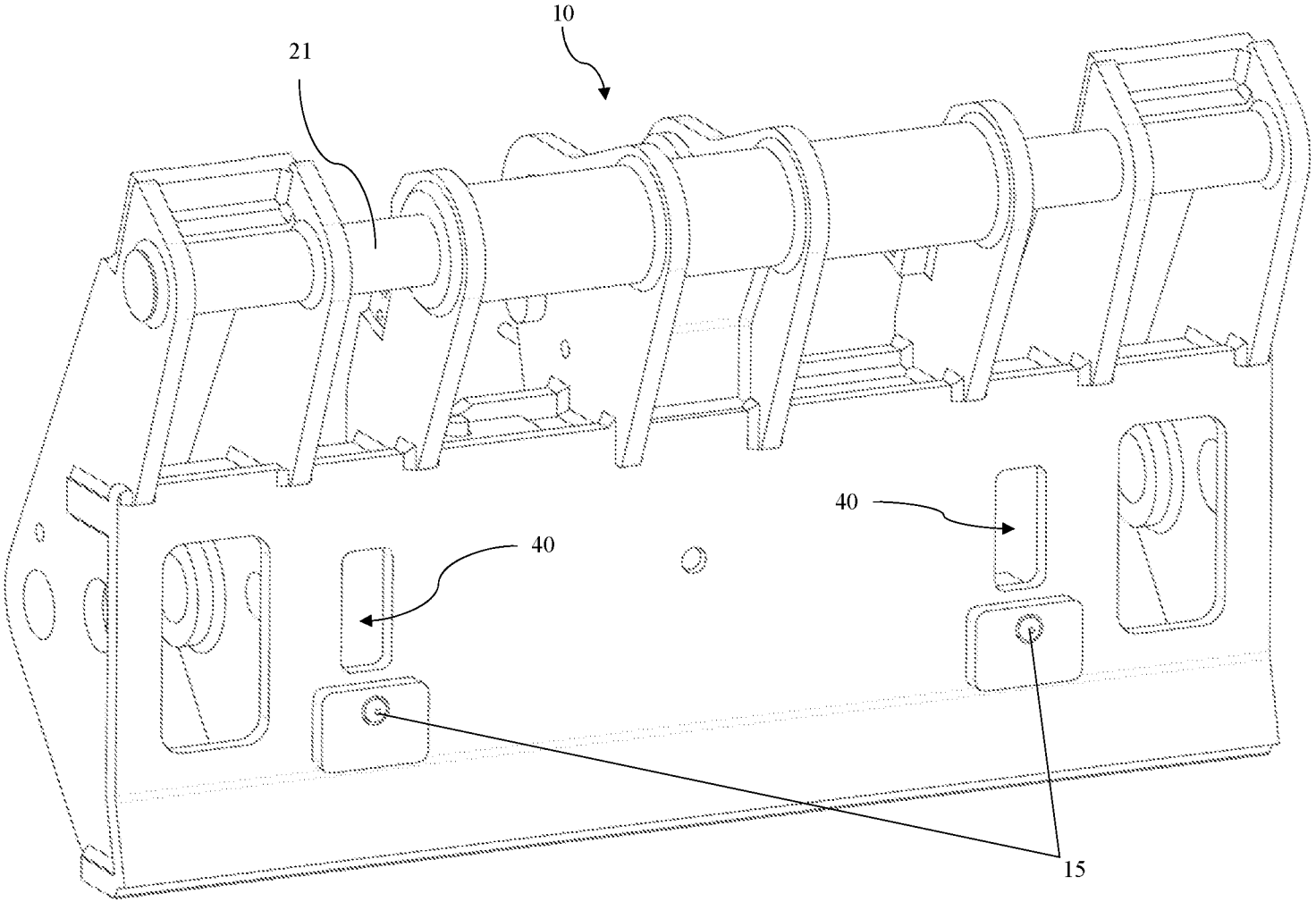
FIG. 3 is a front perspective view of an embodiment of the coupler assembly.
Figure 4:
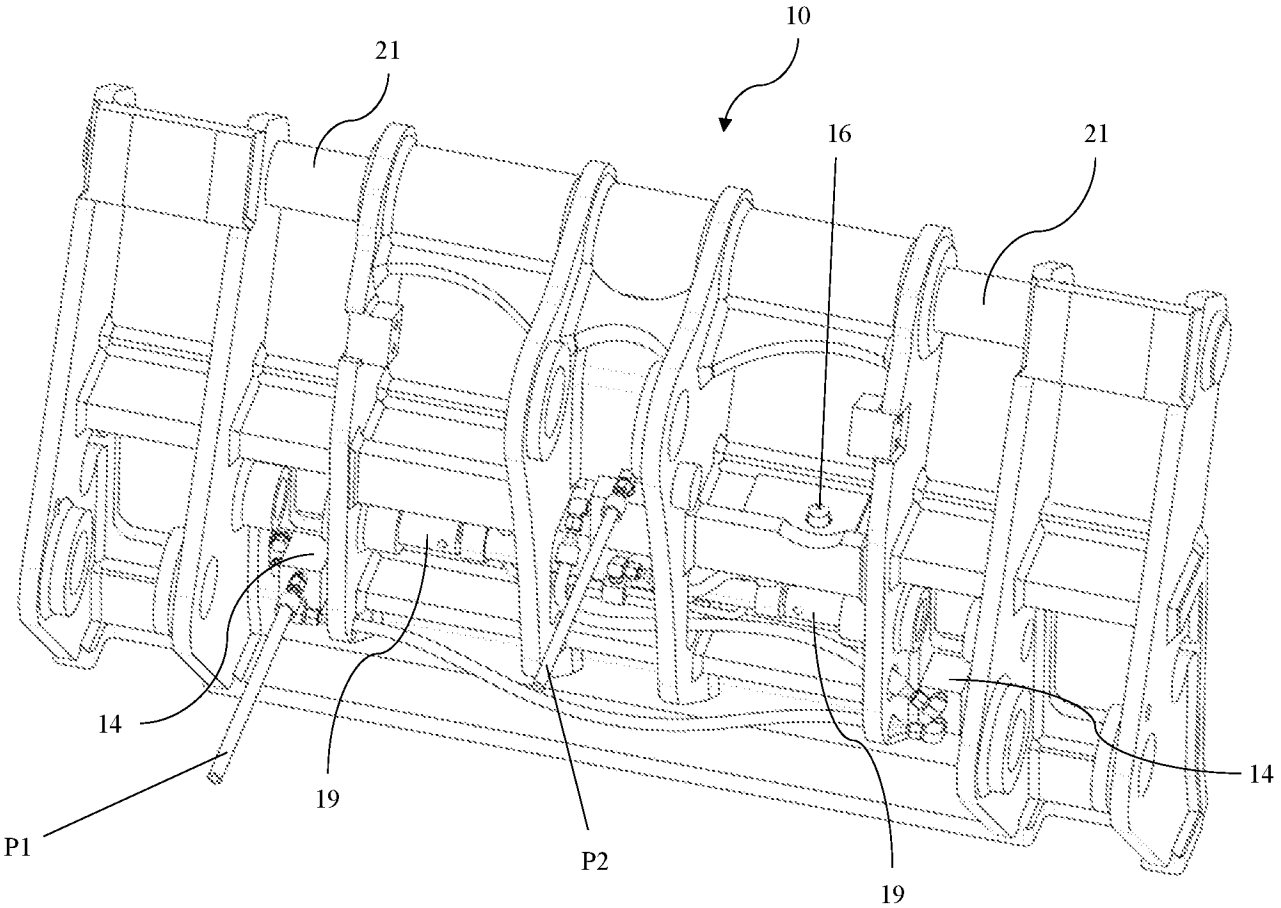
FIG. 4 is a rear perspective view of an embodiment of the coupler assembly.

FIGS. 3 and 4 show the general components of the coupler assembly 10. The coupler assembly 10 includes components configured to selectively attach to a prime mover 13 and to an implement 11. The components of the coupler assembly 10 configured to selectively attach to the implement 11 include an upper generally horizontal member 21 configured to be received by the hooks 31 of an implement 11. The components may also include one or more locking pins 18, which may be the rod of one or more hydraulic or pneumatic cylinders 19, configured to be received by the openings or lugs 25 of an implement 11. In some embodiments the locking pins 18 are operatively connected to the rods of one or more cylinders 19 so that the locking pins 18 are considered an extension of the rods.

The coupler assembly 10 further includes a hydraulic system 50 configured to move the one or more locking pins 18 between an extended position where the locking pins 18 are received by the openings or lugs 25 in the work implement 11 to secure the coupler 10 to the implement 11, and a retracted position wherein the locking pins 18 are retracted from the openings or lugs 25 to allow the implement 11 to be removed from the coupler 10. In the embodiments shown in FIGS. 10-22, the locking pins 18 are the rod of one or more hydraulic cylinders 19 and the terms "locking pins" and "rod" are both sometimes shown and described with reference number 18. In embodiments where more than one locking pin 18 is used to secure the implement 11 to the coupler 10, each locking pin 18 may comprise a separate hydraulic cylinder 19. In other embodiments, like the embodiments shown in FIGS. 10-22, a double acting double rod cylinder 19 having a first piston 48 and rod 18 configured to extend outward in a first direction to engage a first lug 25 and a second piston 48 and rod 18 are configured to extend outward in a second direction to engage a second lug 25. In still other embodiments a standard double acting cylinder 19 having only one rod 18 may be used. In these embodiments the cylinder 19 has only one pressure tap to line P3. The second locking pin 18 could be attached to the opposing end of the cylinder's 19 housing. In some embodiments the locking pins 18 may be actuated by a hydraulic cylinder 19, but the locking pins 18 are separate from the components of the cylinder 19.

The coupler assembly further includes one or more proximity sensors 14 configured to determine whether the implement 11 is in a seated position or a non-seated position relative to the coupler 10. Positioning the implement 11 with the coupler assembly 10 in the seated position may include ensuring the implement 11 is within a predetermined distance from a predetermined area of the coupler assembly 10. It may also include ensuring the implement 11 aligns with the coupler assembly 10 at a predetermined angle. It may also include ensuring the rear face of the implement 11 is aligned in planer parallel with the front face of the coupler assembly 10. In some embodiments proper seating will not occur unless all of the hooks 31 on the implement properly engaged the cross horizontal member 21 on the coupler assembly 10. As described below in more detail, the proximity sensors 14 are in communication with the coupler assembly's 10 hydraulic system 50 and only allow the flow of hydraulic fluid through the system toward the locking pins 18 when the implement 11 is determined to be properly seated with the coupler 10. Each proximity sensor 14 includes a permissive control valve 33 having an open position and a closed position. In the open position hydraulic fluid is allowed to flow in a first direction toward the locking pins 18 and also in a second direction towards the hydraulic supply/reserve tank 22. In the closed position hydraulic fluid is prevented from flowing in the first direction toward the locking pins 18, but is still allowed to flow in the second direction toward the tank 22. The permissive control valve 33 is biased in the closed position so that hydraulic fluid can only pass through toward the locking pins 18 if the proximity sensors 14 detect that the implement 11 is properly seated with the coupler assembly 10. In some embodiments, two proximity sensors 14 are in communication with the hydraulic system 50 in series so that both sensors 14 must be in their open position in order for system pressure to flow toward the cylinder 19.

The proximity sensors 14 help determine whether the implement 11 is property seated against the coupler 10. The proximity sensors 14 may detect the proper seating of the implement 11 and operate the permissive control valve 33 mechanically or electrically. In some embodiments the proximity sensors 14 operate mechanically by physically actuating a plunger 15 that is movable between an extended position and a retracted position and is biased in the extended position. In the extended position the permissive control valve 33 is in its closed position wherein a check valve 24 prevents hydraulic fluid from flowing into the system (toward the locking pins 18), but still allows fluid to flow out of the system toward the tank 22. In the retracted position the permissive control valve 33 is in its open position allowing fluid to flow both into the system toward the locking pins 18 and out of the system toward tank 22. In use, the implement 11 provides force against the plunger 15 when property seated against the coupler assembly 10 to move the plunger 15 to the retracted position. Movement of the plunger 15 to the retracted position opens the permissive control valve 33 to allow hydraulic fluid to flow toward the cylinder 19 for moving the locking pins 18 to the extended position. In other embodiments electrical components may determine proper seating and open the permissive control valve 33 to allow hydraulic fluid to flow toward the locking pins 18.

Figure 5:
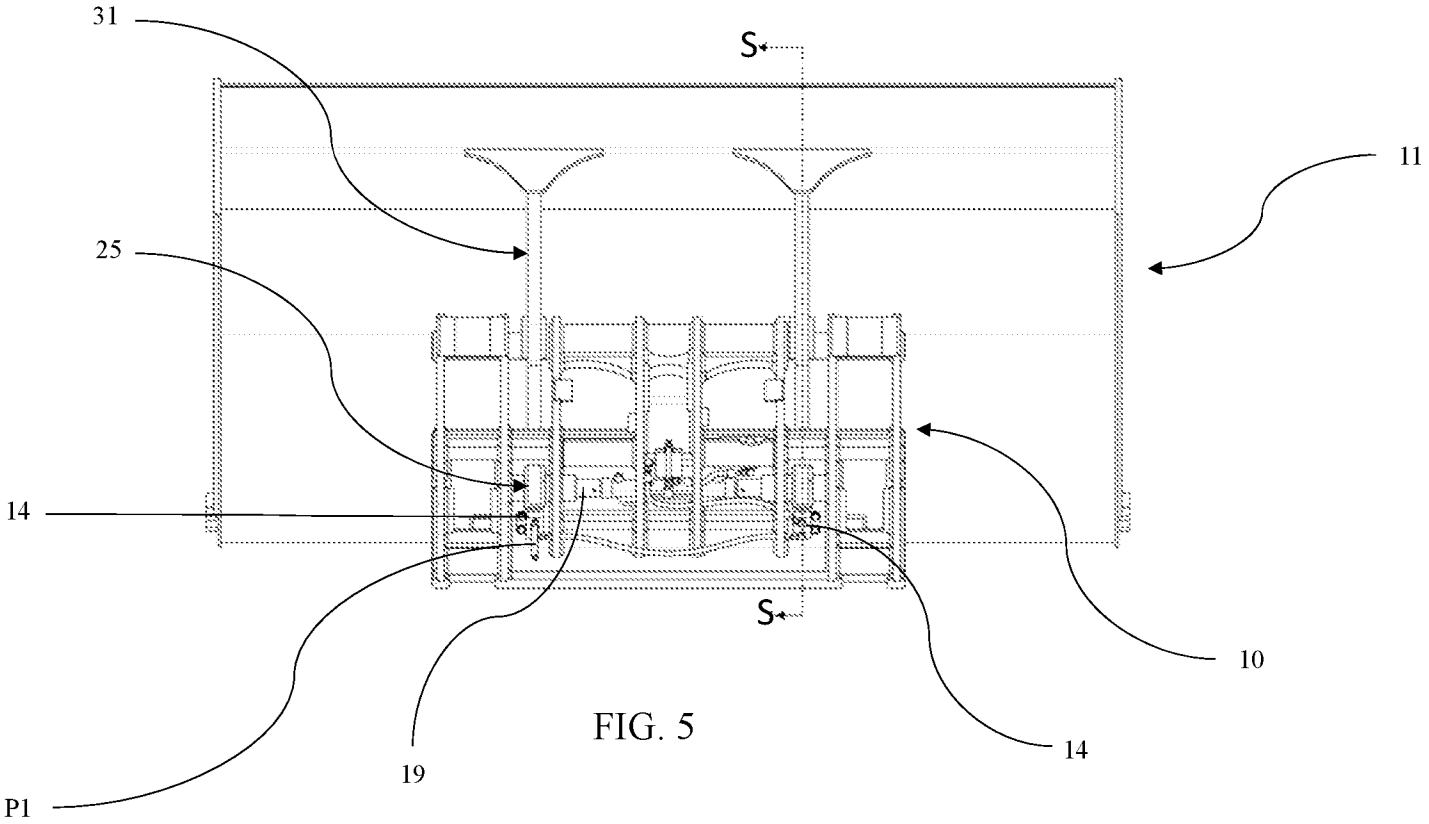
FIG. 5 is a rear view of an embodiment of the coupler assembly attached to an implement.
Figure 6:
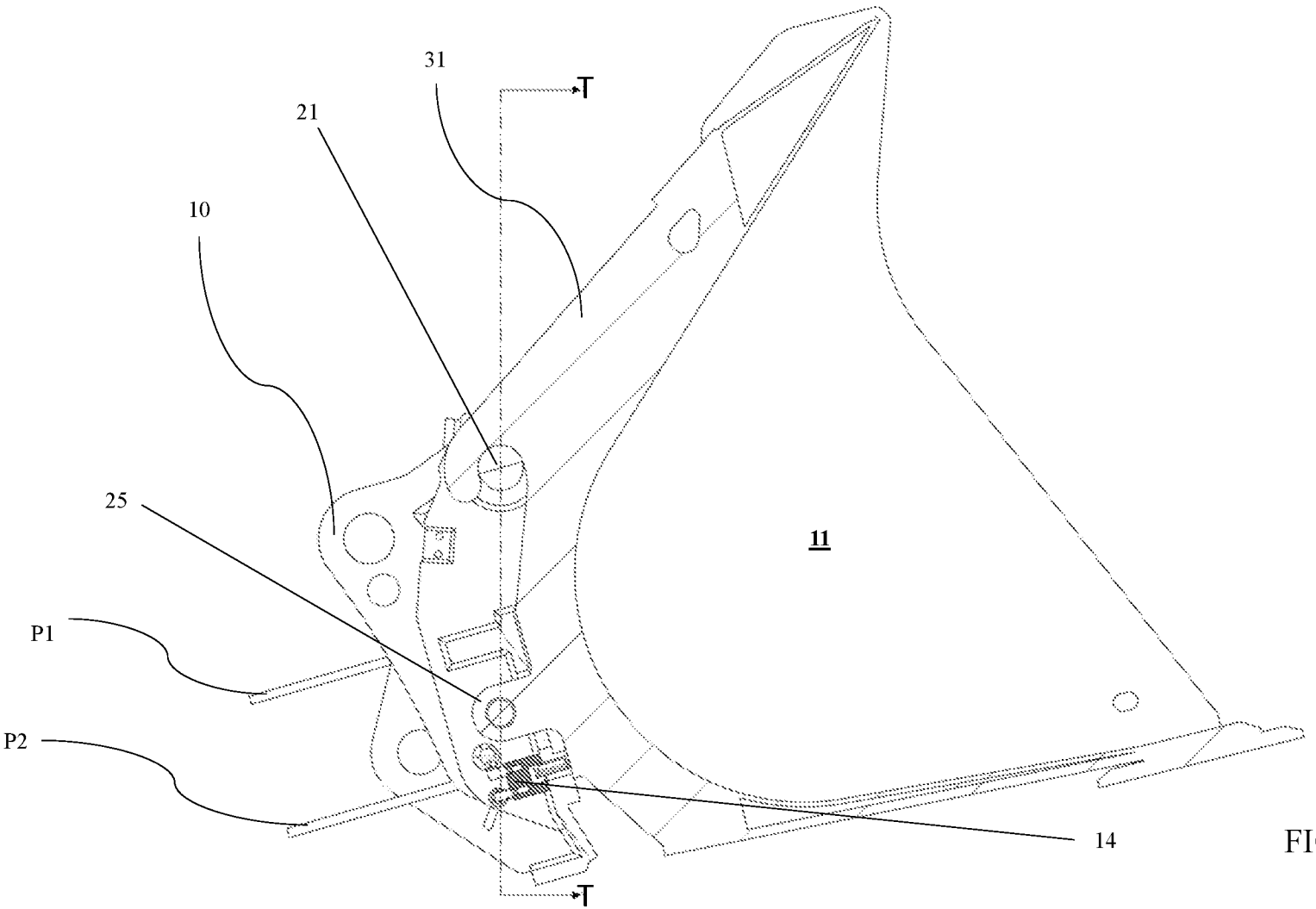
FIG. 6 is a side section view of an embodiment of the coupler assembly attached to an implement taken along section line S-S wherein the proximity sensor is in a first location.
Figure 7:
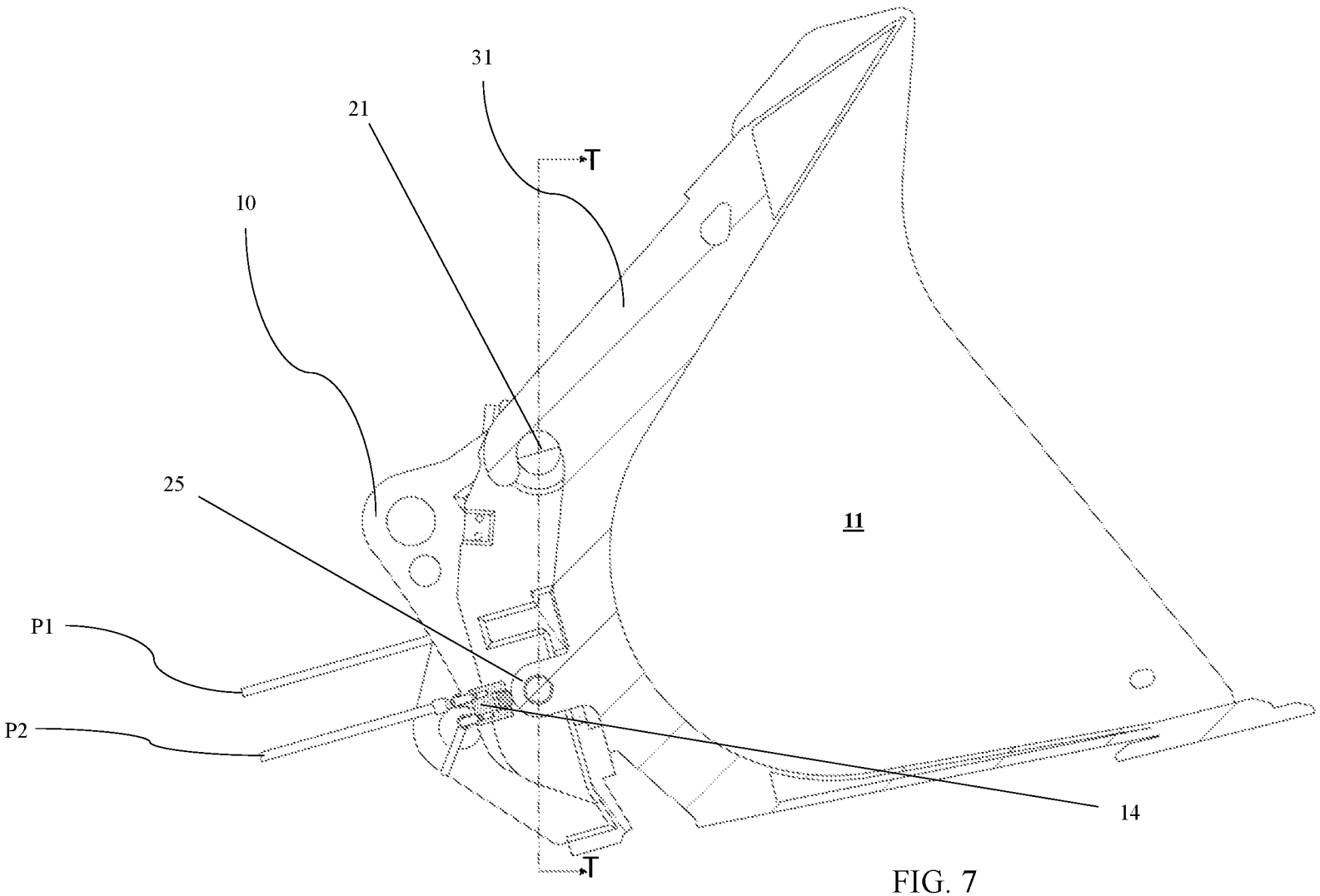
FIG. 7 is a side section view of another embodiment of the coupler assembly attached to an implement takin along section line S-S wherein the proximity sensor is in a second location.

As generally described above, in some embodiments the plunger 15 is positioned to physically engage a portion of the implement 11 when the implement is properly seated against the coupler assembly 10. In some embodiments, the plunger 15 is positioned to extend outward from the front portion of the coupler assembly 10 so that a rearward portion of the implement 11 engages the plunger 15 when property seated against the face of the coupler assembly 10. Multiple plungers 15 may be positioned at different locations on the coupler assembly 10 to help ensure multiple portions of the implement 11 are property seated with the coupler assembly 10. FIGS. 2, 3, 6, and 7 show exemplary locations where the plunger 15 may be positioned on the coupler assembly 10. FIG. 5 shows reference for the section views shown in FIGS. 6 and 7. In FIGS. 2 and 7, two plungers 15 are positioned to be actuated by the rearwardly protruding lugs 25 of the implement 11 as the two components 10, 11 engage each other. The plungers 15 may be positioned behind the front face of the coupler assembly 10 since the lugs 25 are typically received by openings 40 in the front face when properly seated. After the implement's hooks 31 have been positioned on coupler's upper members 21, the lower portion of the implement 11 is rotated backwards toward the coupler assembly 10 and the lugs 25 actuate the plunger 15 if the position and alignment of the coupler assembly 10 and implement 11 is correct. In FIGS. 3 and 6, two plungers 15 are positioned to extend outward from opposing lower lateral surfaces of the front face of the coupler assembly 10. The lower lateral surfaces may be pads or rests on the front face of the coupler assembly 10 configured to receive or cushion corresponding lower portions of the implement 11 as the implement 11 is rotated backwards toward the coupler assembly 10.

The coupler assembly 10 further includes an indicator 16 in communication with the coupler assembly's hydraulic system 50. In some embodiments the indicator 16 is configured to visually indicate a first sign 32 to the operator and a second sign 34 to the operator. The first sign 32 is indicative of the implement 11 not being properly attached to the coupler assembly 10 and the second sign 34 is indicative of the implement 11 being properly attached to the coupler assembly 11. In some embodiments the indicator 16 is a visual indicator which provides an electronic sign or signal, such as a colored light or textual message, to communicate the first sign 32 and the second sign 34. In some embodiments the indicator 16 is a visual indicator which is member such as a flag, bladder, balloon, or pin which physically moves between a first position to indicate the first sign 32 and a second position to indicate the second sign 34. The member may have colors or shapes which help the operator identify whether the indicator is communicating the first sign 32 or the second sign 34. In embodiments where the indicator 16 is a bladder or balloon, when the predetermined conditions are met for a proper connection between the coupler 10 and the implement 11, hydraulic fluid flows into the bladder or balloon causing movement or inflation that is visible to the operator. In some embodiments the indicator 16 is an audio indicator configured to provide a noise to indicate a first sign 32 and/or the second sign 34 to the operator. In some embodiments the indicator 16 is configured to provide other sensory stimuli to the operator to indicate a first sign 32 and/or the second sign 34, such as a vibrating steering wheel, seat, or joystick.

In FIG. 4 the indicator 16 is retracted in the first position to indicate the first sign 34. The indicator 16 is biased in the first position and is only moved to the second position if certain conditions are met. In order for the indicator 16 to be moved to the second position signaling a proper attachment, the proximity sensors 14 must be actuated to satisfy a first condition to allow fluid to flow through the hydraulic system 50 toward the locking pins 18 and the locking pins 18 must be extended to satisfy a second condition to engage the lugs 25. The engagement of the locking pins 18 and lugs 25 is not sensed directly, but the indicator 16 can determine whether the locking pins 18 have been extended beyond a predetermined position by the amount of hydraulic system pressure it receives through line P3. A predetermined amount of system pressure is required to overcome the biasing force to move the indicator 16 to the second position. In some embodiments, if the first condition and the second condition are met, then hydraulic fluid flows through a fluid flow path P3 to the indicator 16 to move the indicator 16 to the second position by hydraulic pressure. In these embodiments, the indicator 16 is biased in the first position by a biasing member 44, such as a spring. The pressure through fluid flow path P3 must be greater than the biasing force of the biasing member 44 in order to move the indicator 16 to the second position. As described below in more detail, there are many conditions wherein the operator may think there is a proper attachment between the implement 11 and the coupler 10, but the attachment is actually improper or unsafe. In these unsafe instances the system is configured to convey less hydraulic pressure to the indicator 16 than necessary to overcome the biasing force, thereby positioning the indicator 16 in its first position. In some embodiments other conditions are also required to convey enough hydraulic pressure to move the indicator 16 to the second position.

Figure 8:
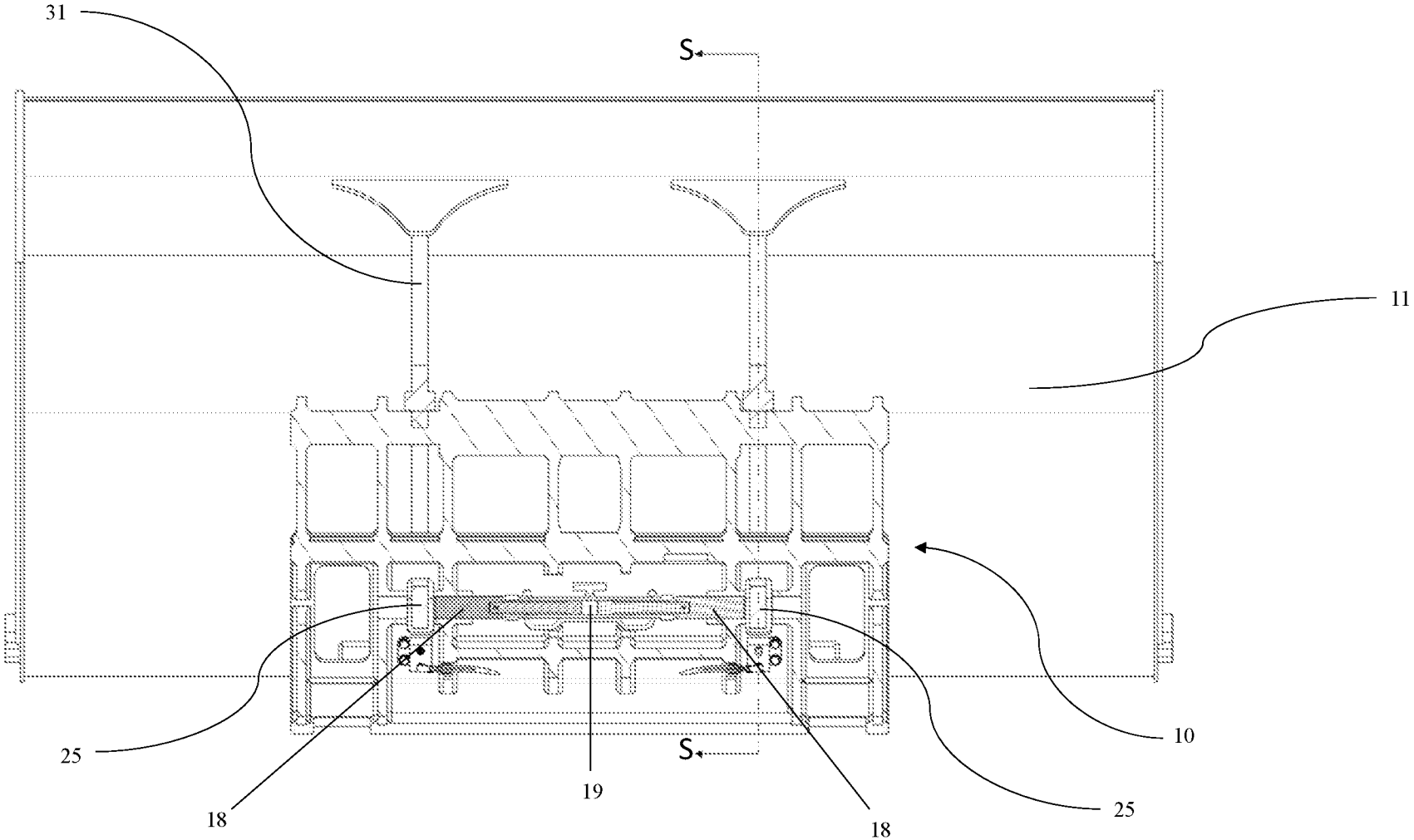
FIG. 8 is a rear section view taken along line T-T showing the locking pins in the retracted position.
Figure 9:
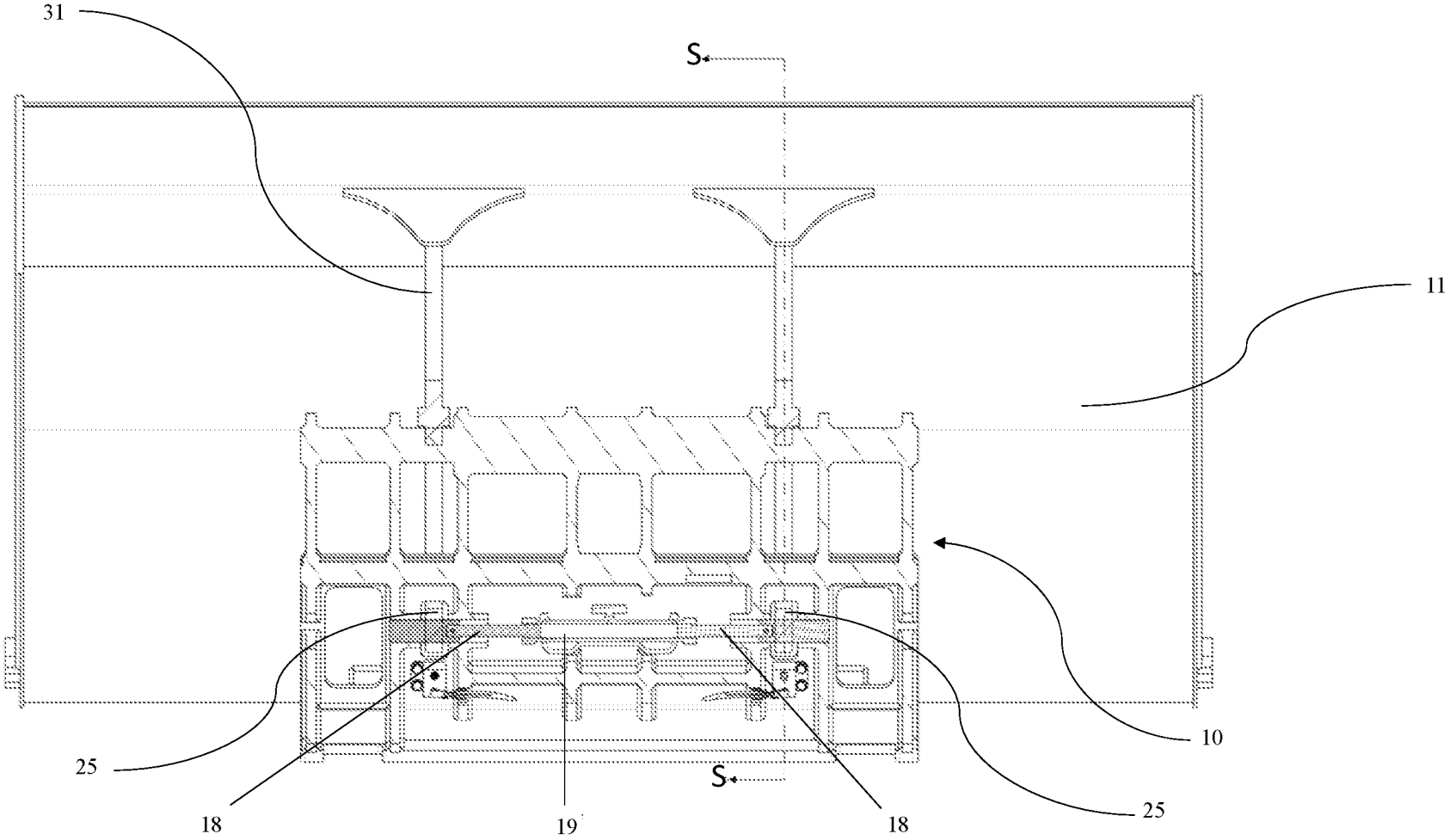
FIG. 9 is a rear section view taken along line T-T showing the locking pins in the extended position.

FIGS. 8 and 9 are section views showing the locking pins 18 in the retracted position (FIG. 8) and extended position (FIG. 9). As noted above and as shown in FIG. 9, in the extended position, the locking pins 18 engage the lugs 25 of the implement 11.

FIGS. 10-22 show the operation of the hydraulic system 50 of the coupler assembly 10 under different conditions. These figures and their accompanying description provide further disclosure about the features described above. The figures show the same hydraulic system 50 under different conditions. A condition or feature described with respect to one of the figures is applicable to the other figures if the system is under the same conditions. The figures show portions of an exemplary hydraulic system for a prime mover vehicle 13, however, the hydraulic system described herein will primarily relate only to the hydraulic system 50 of the coupler assembly 10.

Generally, FIGS. 10-22 show the hydraulic system 50 having two proximity sensors 14, each with permissive control valves 33 actuated by plungers 15, as described above. Line P1 receives system pressure from the hydraulic pump 20 when the operator activates the extension of the locking pins 18. Conversely, line P2 receives system pressure from the hydraulic pump 20 when the operator activates the retraction of the locking pins 18. In the illustrated embodiment, the system pressure is controlled on the machine side by switches 36A and 36B, however, any other suitable actuation control means may be used. The coupler's hydraulic system 50 includes a pilot operated check in both line P1 and line P2. The pilot operated check comprises a check valve 28, 30 in each line P1, P2, respectively, which requires the operator to activate a switch 36A, 36B in order for pressure to flow out of the system (away from the cylinder 19). This helps to prevent the locking pins 18 from moving without operator input. For example, if an implement 11 is attached to the coupler assembly 10 and the system loses pressure due to the hydraulic lines P1, P2 becoming damaged or the pump 20 failing, the check valves 28, 30 will prevent fluid from moving away from the cylinder 19 thereby keeping the locking pins 18 locked in place to help ensure the implement 11 does not inadvertently detach from the coupler assembly 10.

To relieve pressure from the cylinder 19 and unlock the position of the locking pins 18, pilot lines 27, 29 when pressurized, convey pressure to unseat the check valve 30, 28 on the return pressure (vent) side of the system allowing fluid to return to the tank 22. Fluid only passes through pilot lines 27, 29 when the operator actuates either extension or retraction to unseat the check valve 30, 28 on the opposite (return pressure) hydraulic line P1, P2. The pilot lines 27, 29 will not unseat the check valves 30, 28 without action by the operator. System pressure through line P1 extends the locking pins 18 outward toward the extended position (if the proper conditions described herein are met). Line P3 connects the hydraulic cylinder 19 and the indicator 16. Line P3 is in fluid communication with the hydraulic cylinder 19 through junction ports 46 so that system pressure through line P1 enters line P3 only after the locking pins 18 have moved to their extended position. Once the pistons 48 of each locking pin 18 extend past their respective junction ports 46 (from a first side of the junction port 46 to a second side of the junction port 46) to line P3, then system pressure travels through line P3 and moves the indicator 16 against the biasing force provided by the biasing member 44 from the first position showing the first sign 32 to the second position showing the second sign 34. The indicator 16 moves to indicate the second sign 34 because the hydraulic system pressure through line P3 is greater than the biasing force acting on the indicator 16.

A pressure relief valve 38 helps to ensure the indicator 16 does not remain in the second position (continue to show the second sign 34) during retraction when system pressure is introduced into line P2 and line P1 is vented to tank 22. The pressure relief valve 38 has an open position and a closed position and is biased in the closed position. In the open position, the pressure relief valve 38 allows fluid to pass from line P2 to line P1 along line 42, then back to tank 22. The pressure necessary to overcome the biasing force and move the pressure relief valve 38 to the open position is less than the pressure necessary to move/keep the indicator 16 in the second position. Therefore, when P2 is pressurized and P1 is vented, pressure in P3 never reaches full system pressure, but is relieved at the relief set point pressure of relief valve 38, which, in turn, keeps P3 pressure less than needed to move the indicator 16 to the second position.

Figure 10:
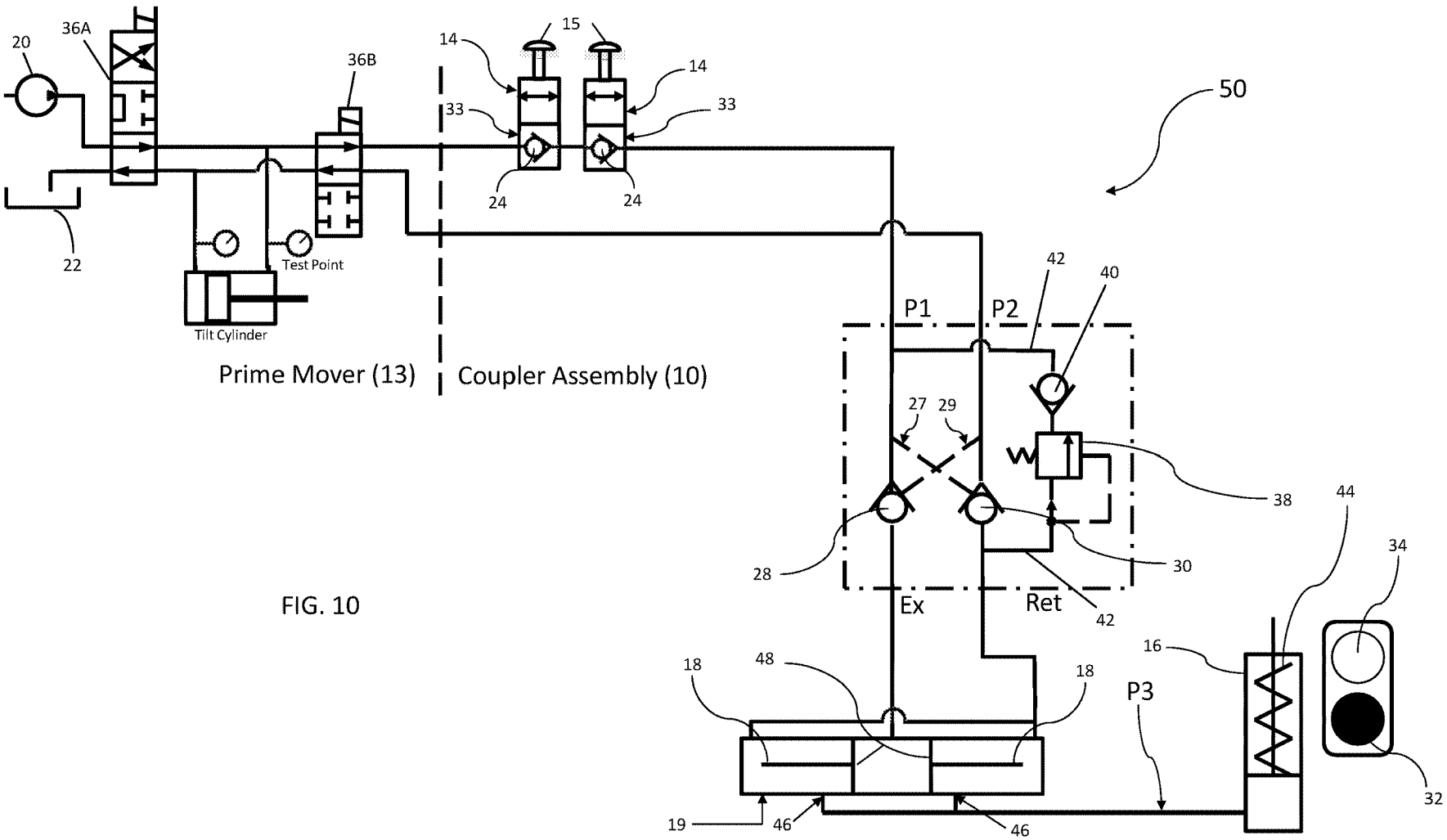
FIG. 10 is a hydraulic circuit diagram showing a first load case scenario.

FIG. 10 shows a condition where the implement 11 is attached to the coupler 10 or an implement 11 is improperly seated against the coupler 10. The operator has activated the extension of the locking pins 18. The proximity sensors 14 are in their extended/non-actuated/closed state thereby preventing hydraulic fluid from flowing through the permissive control valve 33 toward the locking pins 18. The indicator 16 is in the first position since it is not receiving system pressure, indicating the implement 11 is not properly attached to the coupler 10. Note, the embodiment shown includes two proximity sensors 14 positioned at different locations on the coupler 10, however, any number may be used. The proximity sensors 14 shows are combined with the coupler assembly's 10 hydraulic system 50 in series so that both sensors 14 must be in their open position in order for system pressure to flow toward the cylinder 19.

Figure 11:
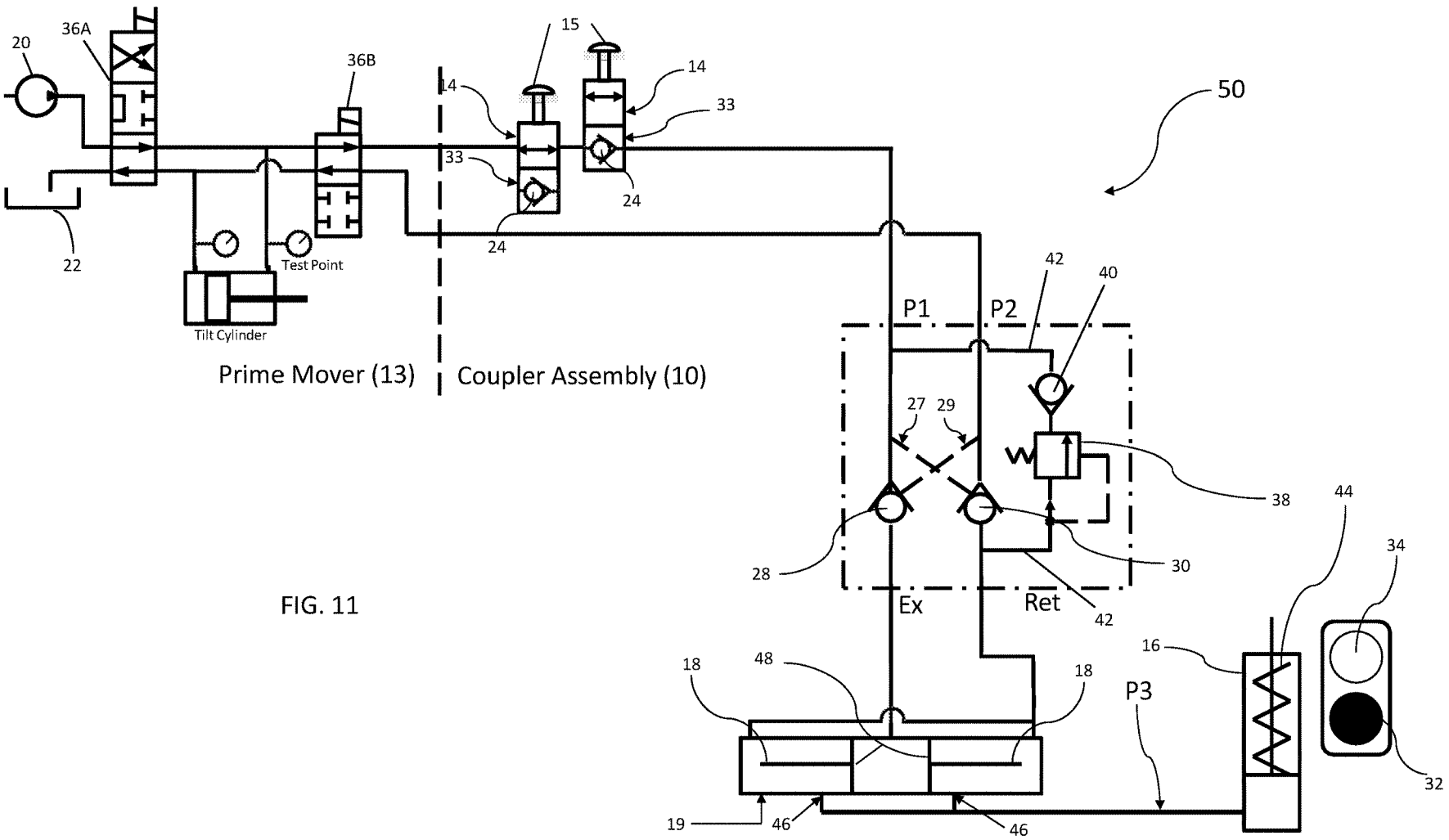
FIG. 11 is a hydraulic circuit diagram showing a second load case scenario.

FIG. 11 shows a condition where the operator has activated the extension of the locking pins 18 and one of the proximity sensors 14 has been actuated to open the permissive control valve 33, but the second proximity sensor 14 has not been actuated thereby preventing hydraulic fluid from flowing through the second permissive control valve 33 toward the locking pins 18. This condition indicates that the implement 11 is improperly seated or misaligned on the coupler 10. In this embodiment both of the proximity sensors 14 must by actuated to allow fluid to flow through the permissive control valve 33 toward the locking pins 18. The indicator 16 remains biased in the first position since it is not receiving system pressure, indicating the implement 11 is not properly attached to the coupler 10.

Figure 12:
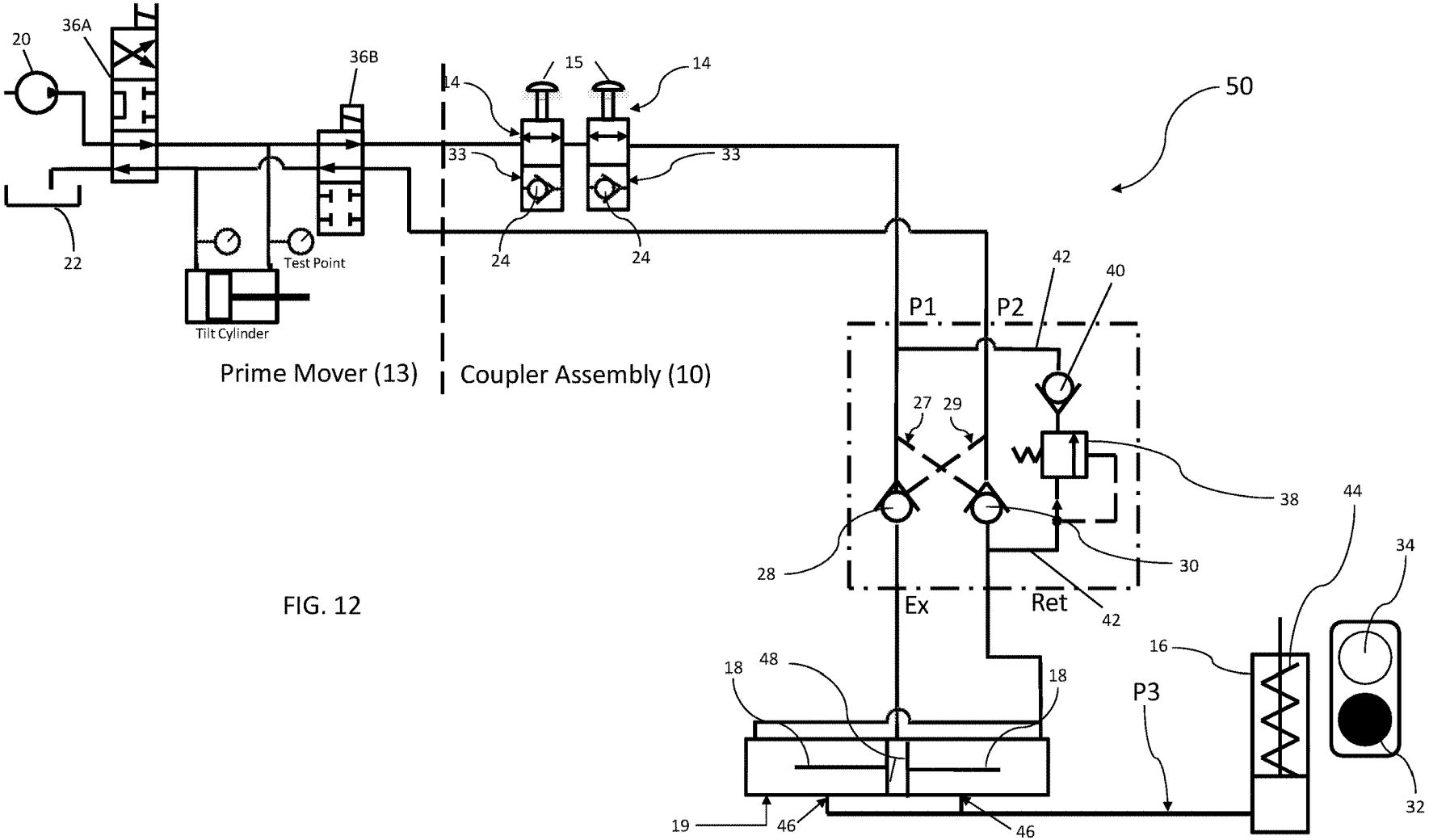
FIG. 12 is a hydraulic circuit diagram showing a third load case scenario.

FIG. 12 shows a condition where the locking pins 18 are extending, but have not yet reached their fully extended position, the implement 11 is properly seated against the coupler 10, as indicated by the proximity sensors 14 having been actuated to allow fluid to pass through the permissive control valves 33 toward the locking pins 18 via line P1. As the locking pins 18 move toward extension, hydraulic fluid is flowing toward the hydraulic cylinder 19 through line P1 where the fluid enters the cylinder 19 on the piston side. Hydraulic fluid is venting from the rod 18 side of the cylinder 19 toward the tank 22 through line P2 as the locking pins 18 extend. The indicator 16 is in the first position indicating the implement 11 is not properly attached to the coupler 10 since the pins 18 have not yet fully extended and the indicator 16 is not yet receiving system pressure. The rod side of the cylinder 19 is in fluid communication with line P3, however, the rod side pressure, which is the return pressure (vent) in communication with the tank 22, is not enough to move the indicator 16 to the second position. As explained elsewhere herein, each of the primary lines P1 and P2 contain a pilot operated check comprising check valve 28, 30, respectively, to help maintain system pressure to the locking pins 18 and to the indicator 16 when the control switches 36A, 36B are moved to neutral after the locking pins 18 have been fully extended. When hydraulic fluid is being pumped through the system in either the forward or reverse direction, one of the check valves 28, 30 is unseated to allow fluid to flow back to tank 22. For example, during extension, fluid flows from the pump 20 through line P1 toward the hydraulic cylinder 19. A small amount of hydraulic fluid passes through pilot line 27 to unseat check valve 30, thereby allowing return/vented fluid to flow from rod 18 side of the hydraulic cylinder 19 toward the tank 22 through line P2. During retraction of the locking pins 18, fluid flow from the pump 20 through line P2 toward the hydraulic cylinder 19. A small amount of hydraulic fluid passes through pilot line 29 to unseat check valve 28, thereby allowing fluid to flow from the hydraulic cylinder 19 toward the tank 22 through line P1.

Figure 13:
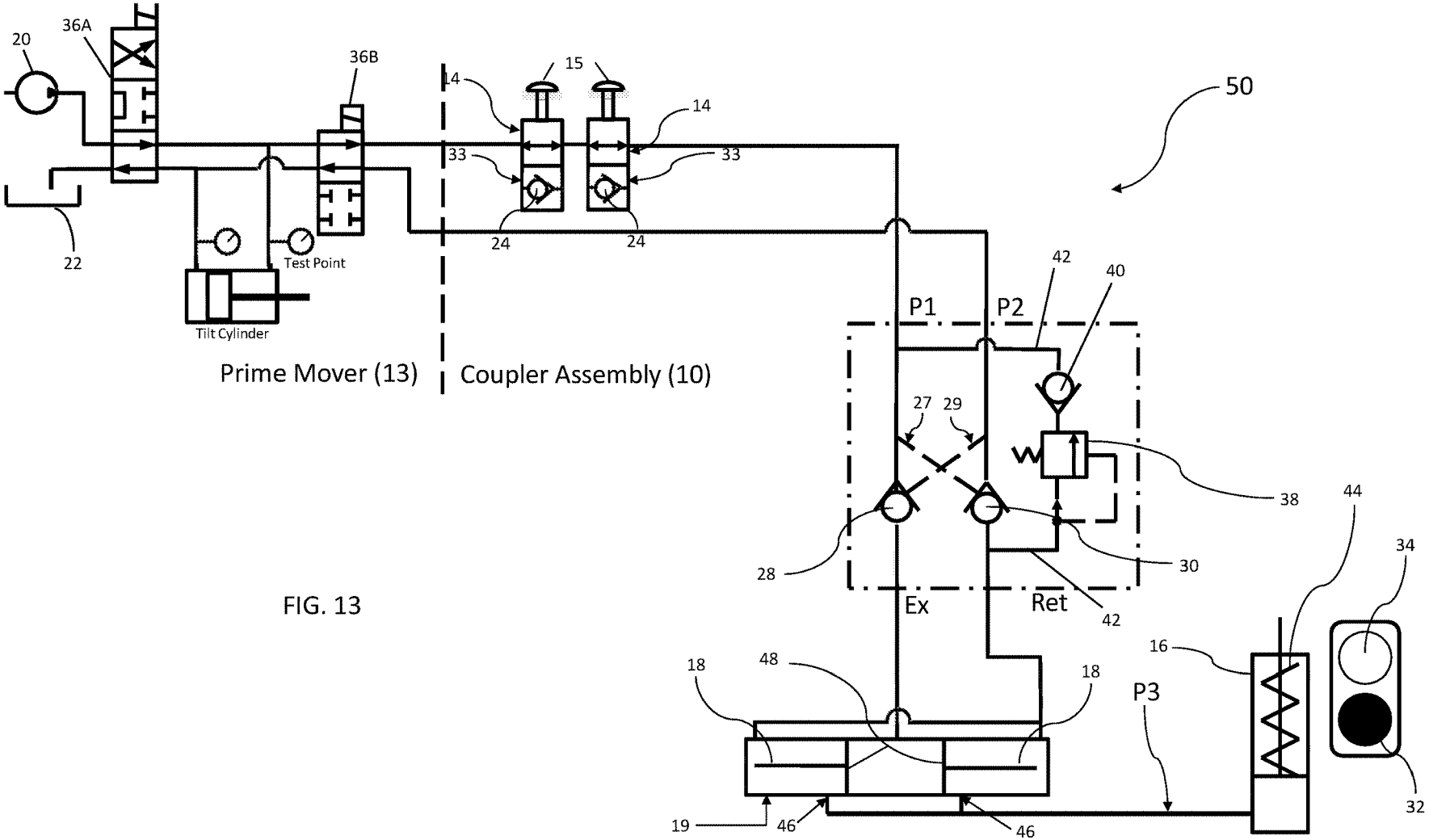
FIG. 13 is a hydraulic circuit diagram showing a fourth load case scenario.

FIG. 13 shows a condition where the implement 11 is properly seated against the coupler 10, as indicated by the proximity sensors 14 which have been actuated to allow fluid to pass through the permissive control valves 33 toward the locking pins 18 and the operator has activated the extension of the locking pins 18. In this condition, hydraulic fluid began to flow toward the hydraulic cylinder 19 through line P1, but both of the locking pins 18 stalled short of full extension. The indicator 16 is in the first position indicating the implement 11 is not properly attached to the coupler 10. Since the pins 18 have not yet fully extended, system pressure is not received by the indicator 16 through line P3, so the biasing force of the biasing member 44 holds the indicator 16 in the first position. In some embodiments, in order for line P3 to receive system pressure, the cylinder's 19 rods 18 need to be at full stroke or nearly at full stroke before junction ports 46 are exposed to system pressure and the indicator 16 is properly actuated.

Figure 14:
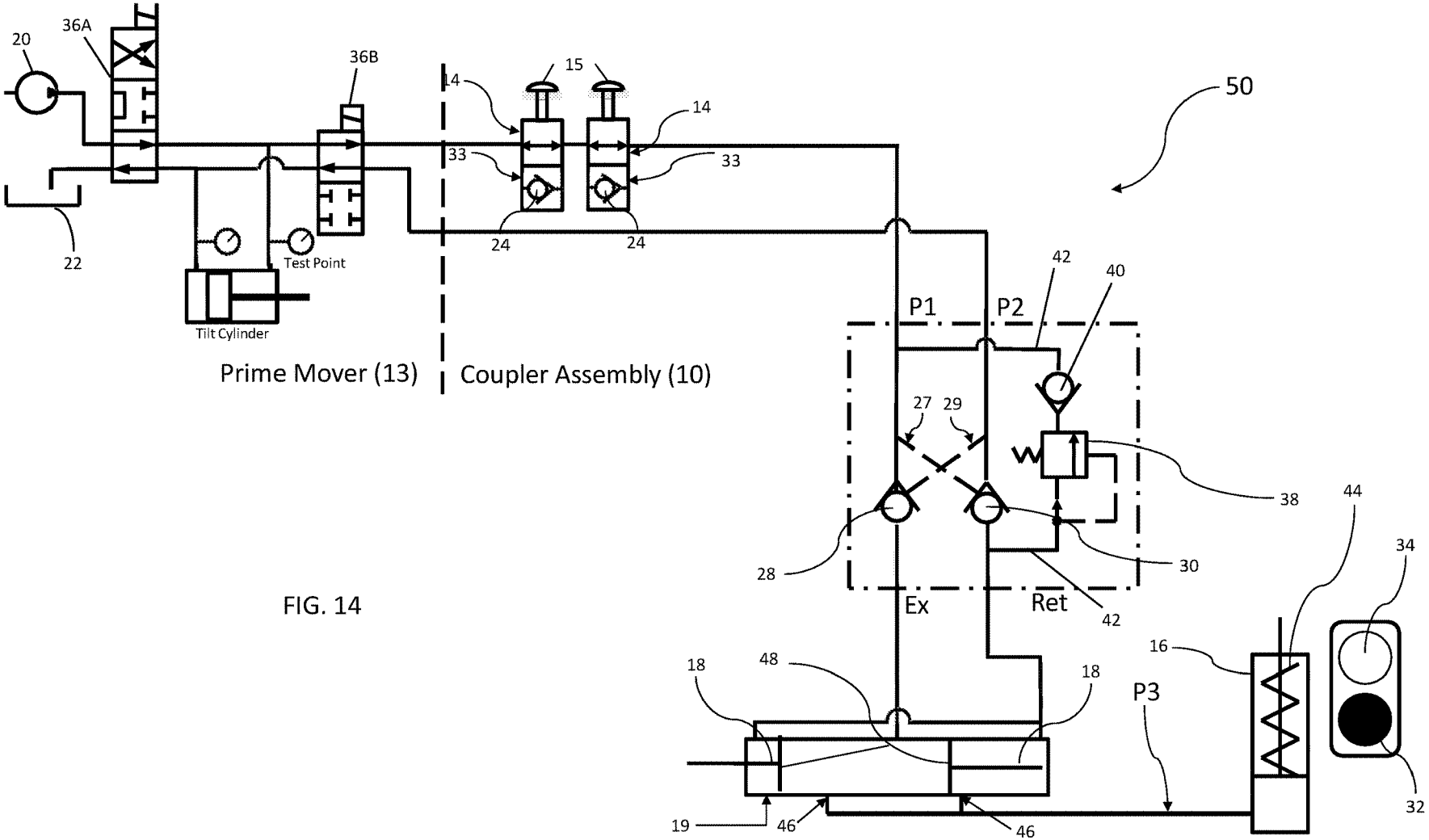
FIG. 14 is a hydraulic circuit diagram showing a fifth load case scenario.

FIG. 14 shows a condition where one of the locking pins 18 is fully extended and the other locking pin 18 stalled short of full extension. The implement 11 is properly seated against the coupler 10, as indicated by the proximity sensors 14 which have been actuated to allow fluid to pass through the permissive control valves 33 toward the locking pins 18. Hydraulic fluid is flowing toward the hydraulic cylinder 19 through line P1 and hydraulic fluid is flowing from the cylinder 19 toward the tank 22 through line P2 as the locking pins 18 extend. One extended locking pin 18 has moved far enough to allow system pressure to pass through one of the junction ports 46 into line P3 toward the indicator 16. However, the other locking pin 18 which has not fully extended provides a fluid pathway through its respective junction port 46 for the system pressure in line P3 to move back to tank through line P2. The amount of pressure necessary to overcome the biasing force and activate the indicator 16 is more than the system return pressure to tank 22. Therefore, the indicator 16 remains is in the first position indicating the implement 11 is not properly attached to the coupler 10 since the locking pins 18 have not yet fully extended. In other embodiments (not shown), each locking pin 18 may be fluidly connected to its own indicator 16.

Figure 15:
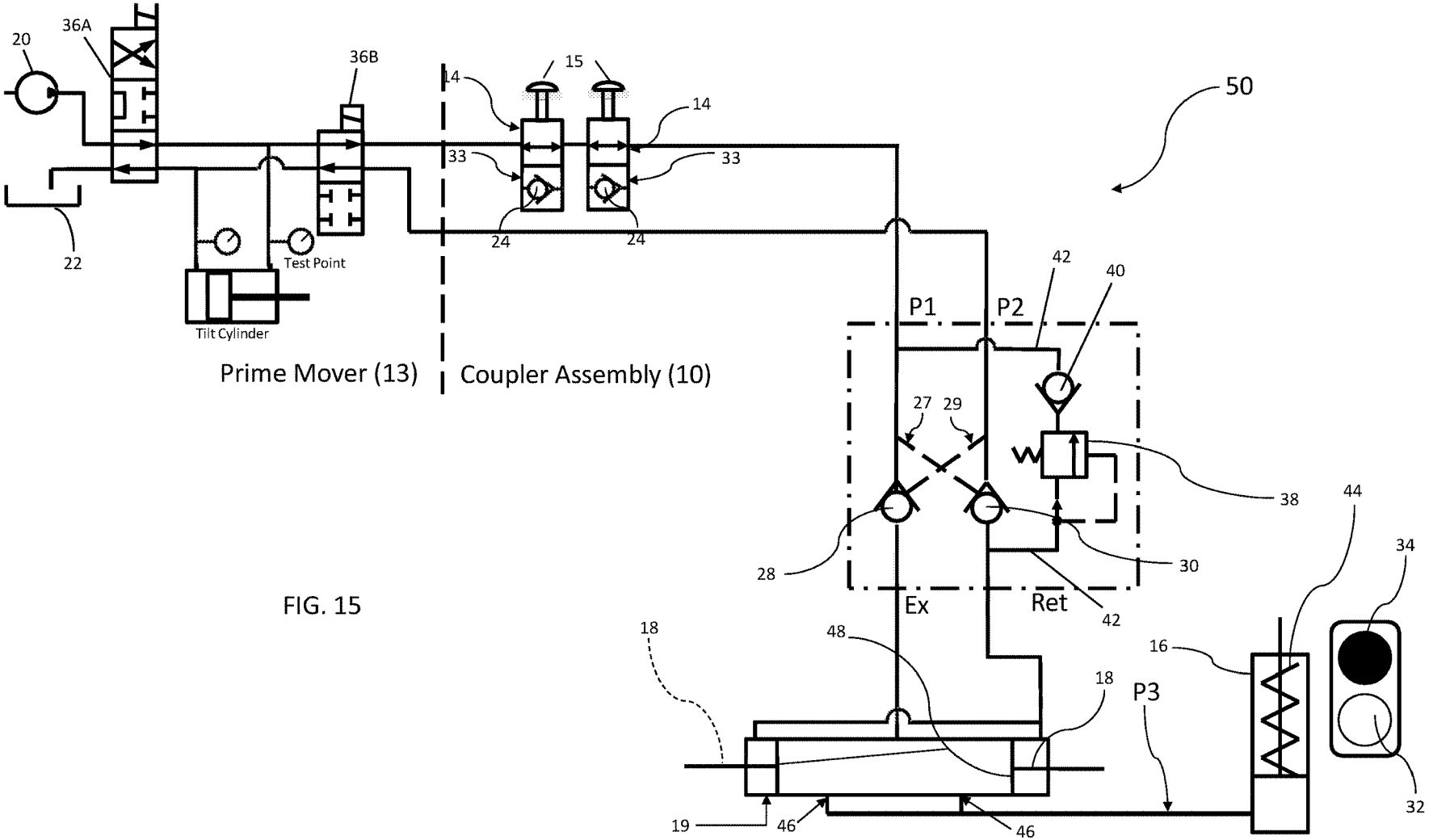
FIG. 15 is a hydraulic circuit diagram showing a sixth load case scenario.

FIG. 15 shows a condition where the coupler assembly 10 has successfully aligned with and locked to the implement 11. The implement 11 is properly seated against the coupler 10 and the locking pins 18 have both fully extended. During extension hydraulic fluid system pressure flows toward the hydraulic cylinder 19 through line P1 and hydraulic fluid return pressure (vent) flows from the cylinder 19 toward the tank 22 through line P2. Both of the locking pins 18 have fully extended thereby allowing hydraulic fluid system pressure to enter line P3 from the piston side of both pins 18. Line P3 is in fluid communication with the hydraulic cylinder 19 through junction ports 46 positioned where line P3 receives system pressure from line P1 only after the piston 48 has been extended to a predetermined position that is far enough for the locking pin/rod 18 to extend through the opening in the lug 25. The system pressure through line P3 is greater than the biasing force acting on the indicator 16, thereby moving the indicator 16 to the second position indicating the implement 11 is properly attached to the coupler 10. In this illustration, two conditions are met to allow system pressure to reach the indicator. Namely, the implement 11 is properly seated and the locking pins 18 are fully extended.

Figure 16:
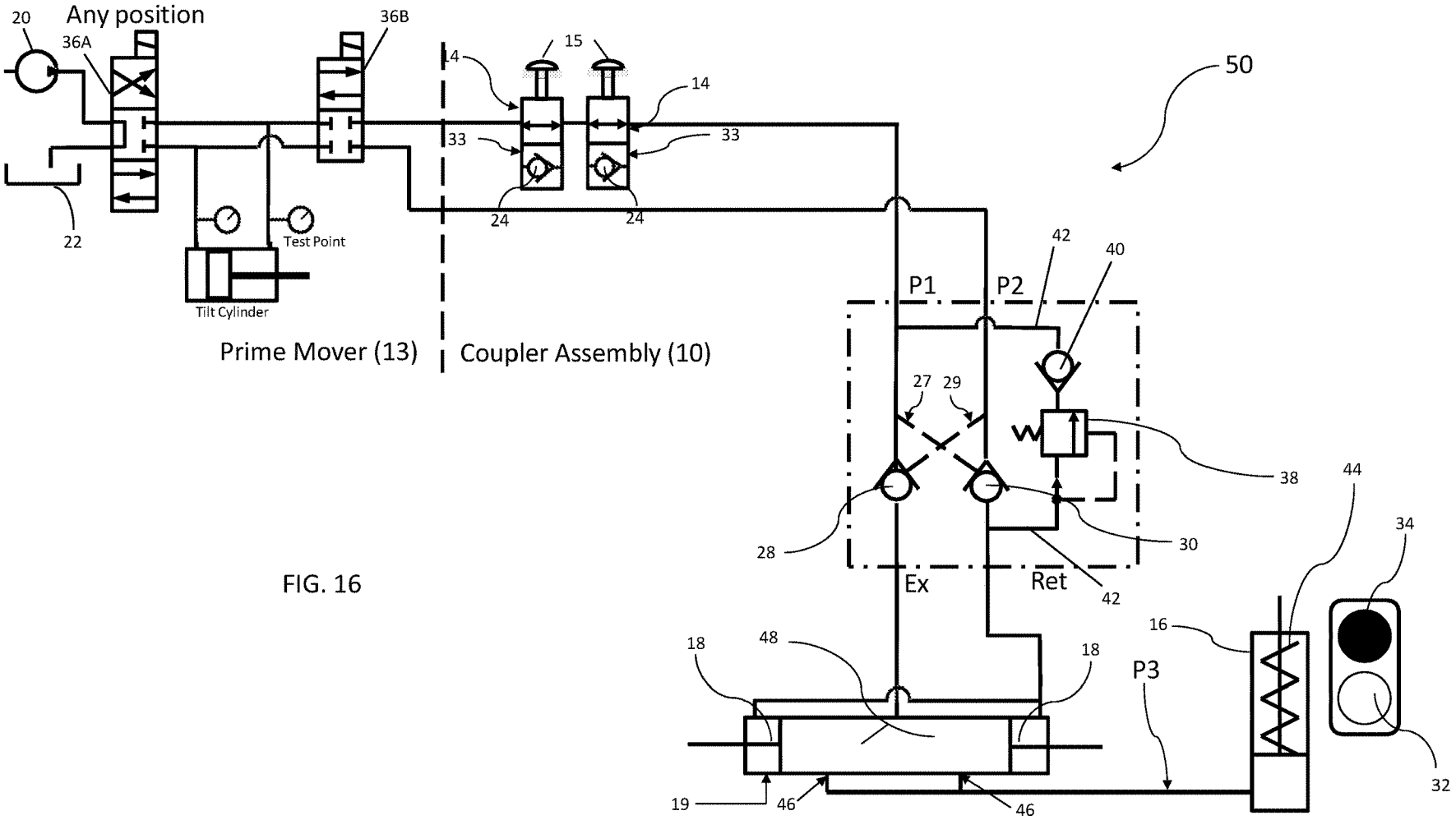
FIG. 16 is a hydraulic circuit diagram showing a seventh load case scenario.

FIG. 16 shows a condition where the operator has moved one or both of the switches 36A, 36B to neutral so the hydraulic motor 20 is no longer pumping fluid through the hydraulic system 50. The implement 11 is properly seated against the coupler assembly 10 and both of the locking pins 18 have fully extended thereby allowing hydraulic fluid to enter line P3 and move the indicator 16 to the second position, indicating the implement 11 is properly attached to the coupler 10. Check valves 28 and 30 hold system pressure in the cylinder 19 and in the indicator 16, thereby ensuring the locking pins 18 remain extended and the indicator 16 remains in the second position.

Figure 17:
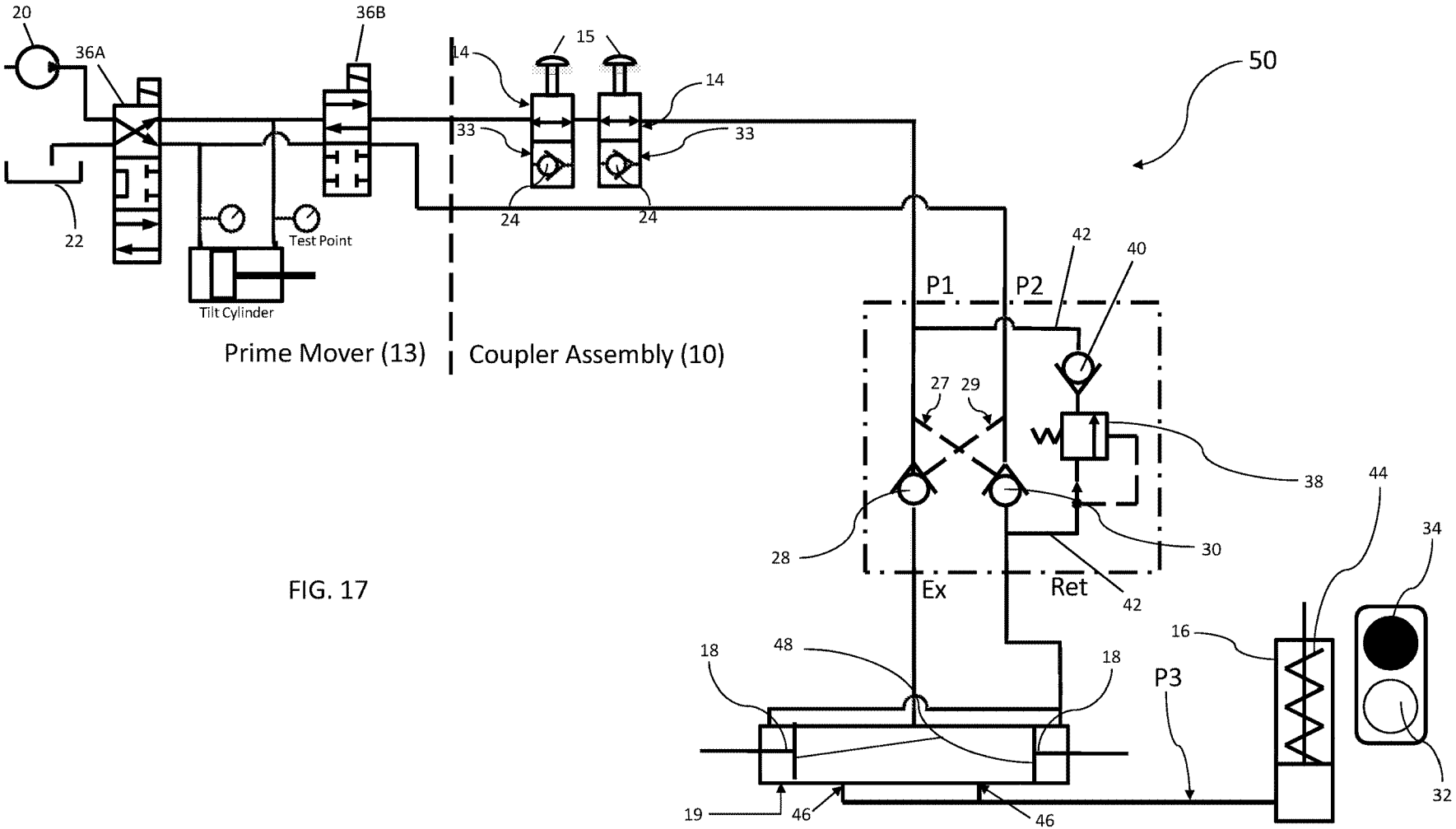
FIG. 17 is a hydraulic circuit diagram showing an eighth load case scenario.

FIG. 17 shows a condition where system pressure is leaking into the hydraulic system 50 through the retract side of the switch's 36A, 36B valves and into line P2. The pilot operated check system prevents the locking pins 18 from retracting because the leak pressure is not enough to unseat check valve 28 through pilot line 29. A full (or nearly full) amount of system pressure is required through either line P1 or P2 in order to provide enough pressure through the respective pilot line 27, 29 to unseat the respective check valve 30, 28. The check valves 28, 30 hold system pressure in the cylinder 19 and indicator 16 despite the pressure leak.

Figure 18:
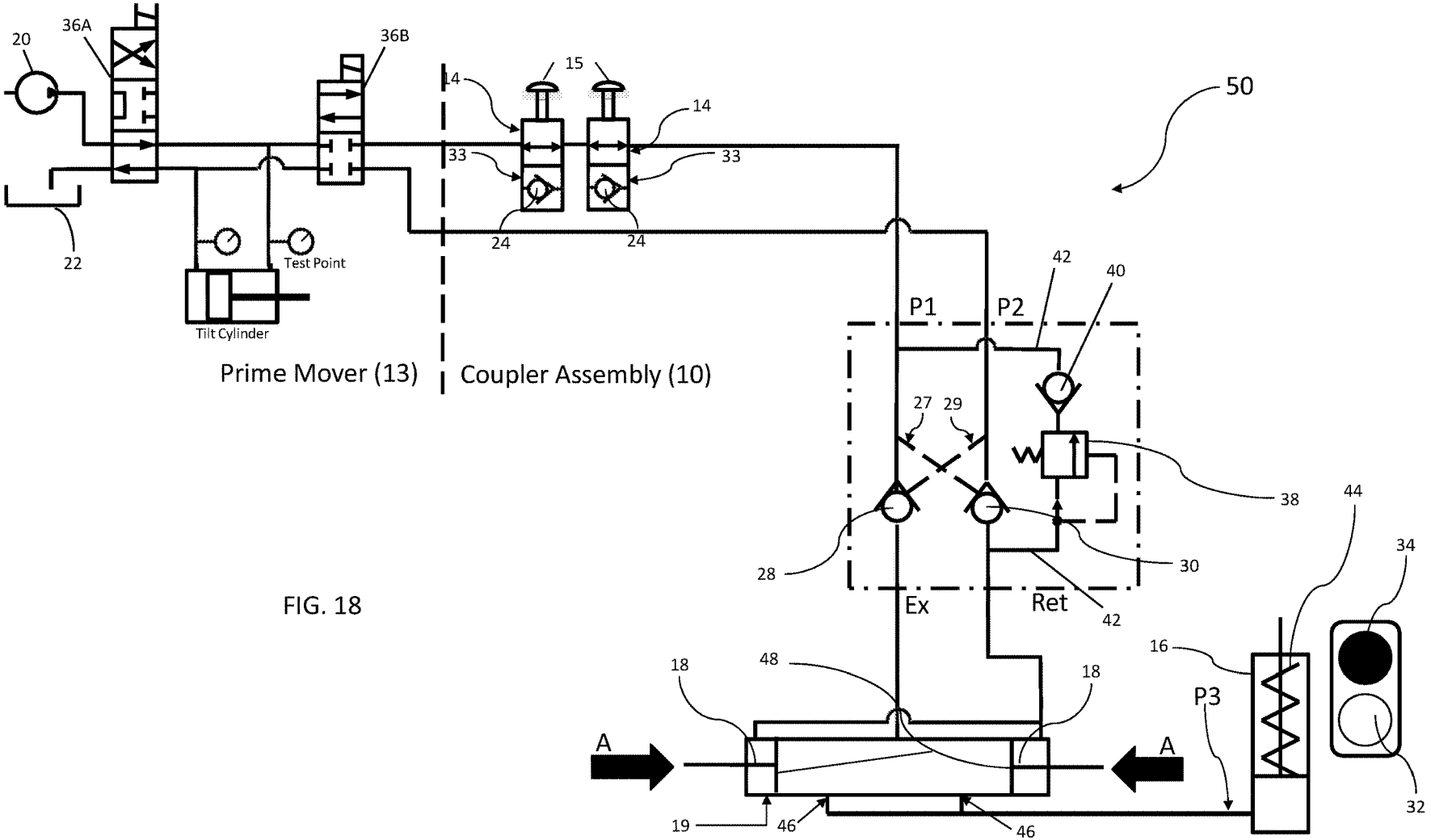
FIG. 18 is a hydraulic circuit diagram showing a ninth load case scenario.

FIG. 18 shows a condition where an external force, indicated by the arrows A, is trying to force the locking pins 18 to retract when the control switch 36B is in neutral. The implement 11 is properly seated against the coupler 10 assembly and both of the locking pins 18 have fully extended thereby allowing hydraulic fluid to enter line P3 and move the indicator 16 to the second position indicating the implement 11 is properly attached to the coupler 10. The pilot operated check valves 28 and 30 hold system pressure in the cylinder 19 even if an external force A tries to push the locking pins 18 back to their retracted position.

Figure 19:
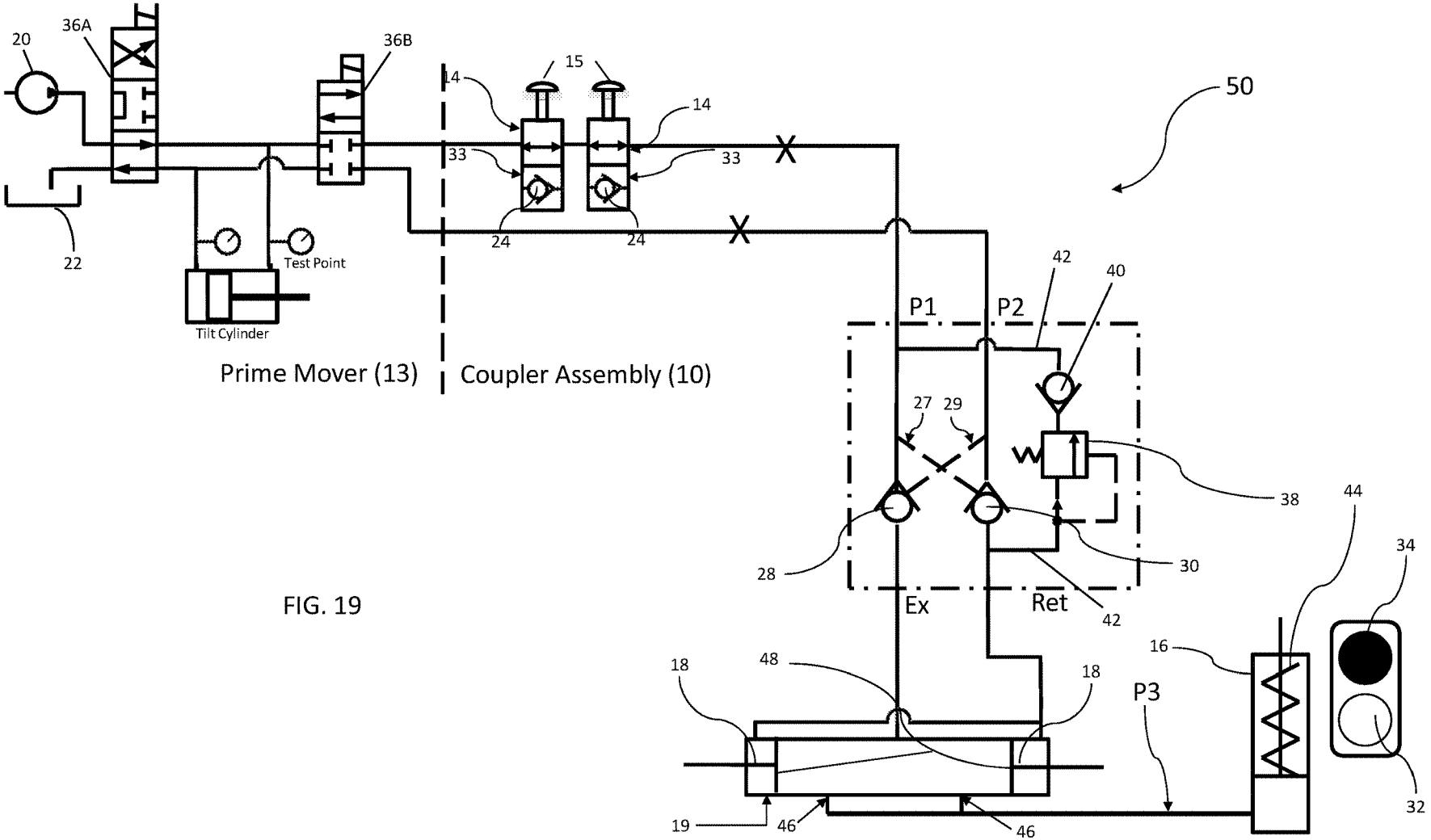
FIG. 19 is a hydraulic circuit diagram showing a tenth load case scenario.

FIG. 19 shows a condition similar to the one shown in FIG. 18, however, in FIG. 19 the hoses P1 and/or P2 are damaged as indicated by the Xs. Pilot operated check valves 28 and 30 hold system pressure thereby ensuring the locking pins 18 remain extended and the indicator 16 remains in the second position.

Figure 20:
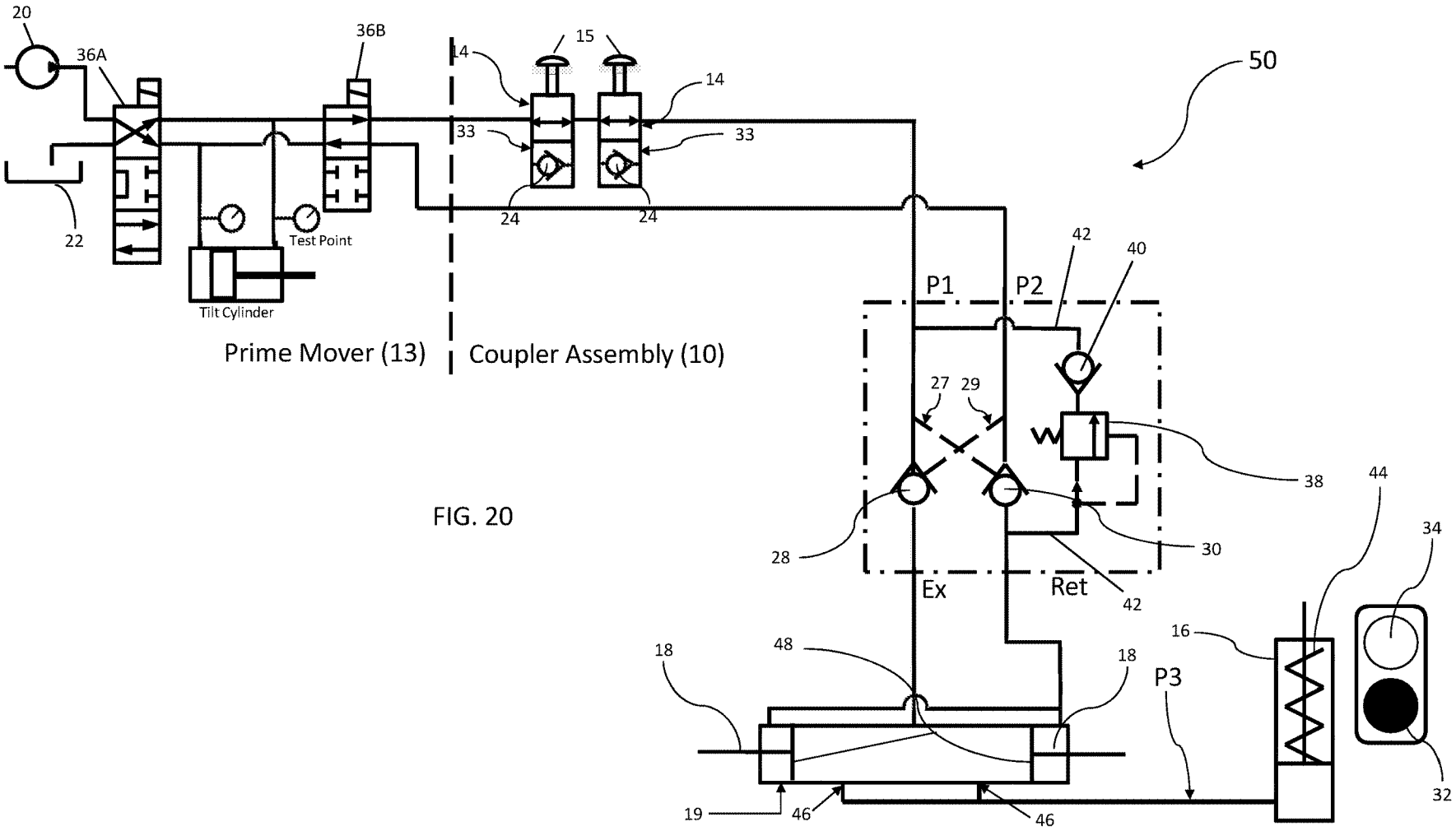
FIG. 20 is a hydraulic circuit diagram showing an eleventh load case scenario.

FIG. 20 shows a condition where the operator has activated the retraction of the locking pins 18 so system pressure from the hydraulic motor 20 moves through line P2 toward the rod side of the cylinder 19. As described above, some fluid passes through pilot line 29 causing check valve 28 to become unseated so fluid from the piston side of the cylinder 19 can be returned to tank 22. In this condition, the pistons 48 have not yet retracted past the junction ports 46. The indicator 16 moves to the first position since the system return pressure is less than the pressure required to hold the indicator in the second position.

Figure 21:
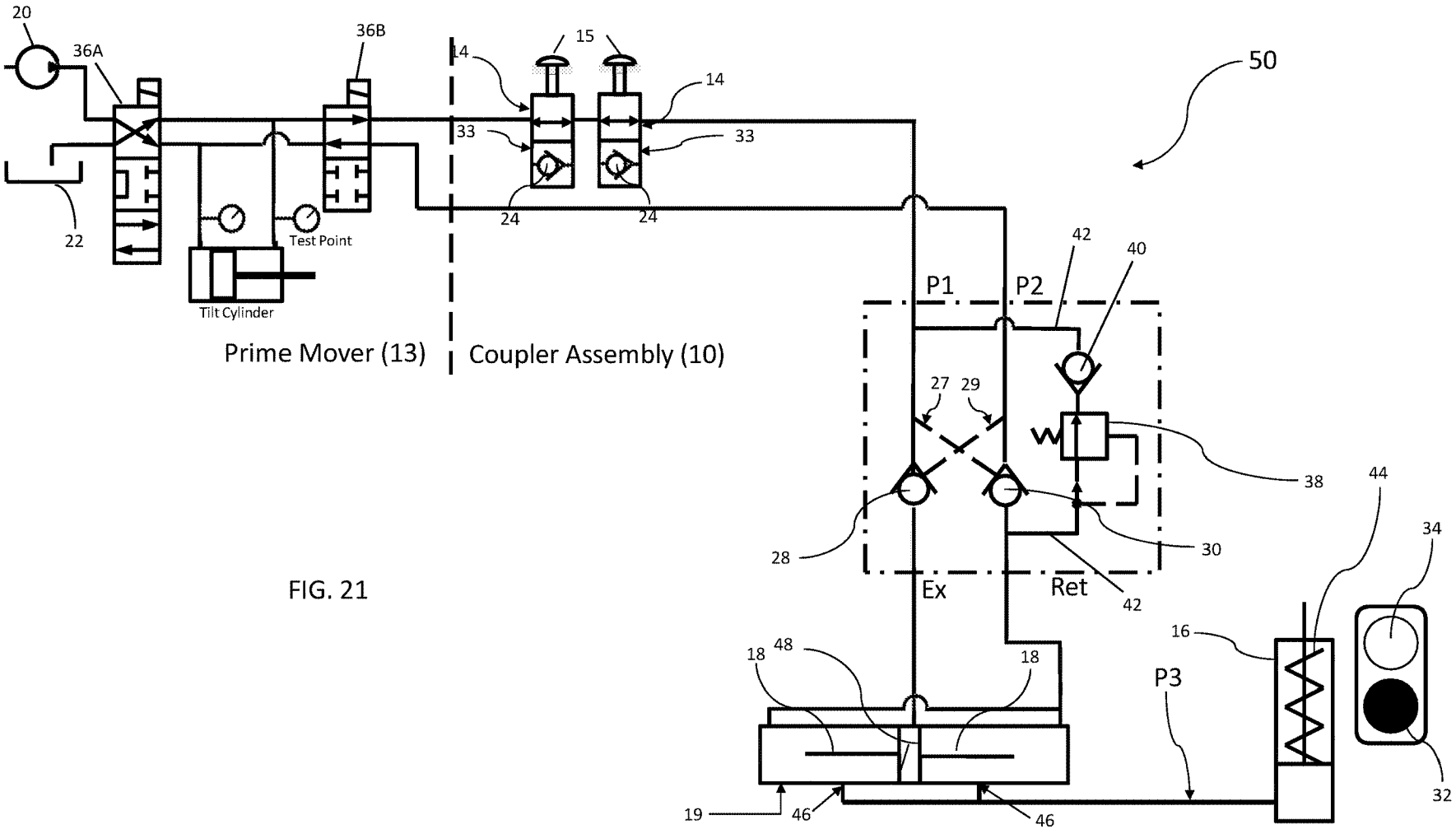
FIG. 21 is a hydraulic circuit diagram showing a twelfth load case scenario.

FIG. 21 shows a condition similar to FIG. 20, but in this condition the pistons 48 have retracted past the junction ports 46. After the locking pins 18 retract far enough that the pistons 48 pass the junction ports 46, line P3 could be exposed to the system pressure causing the indicator 16 to falsely show the second sign 34. A pressure relief valve 38 helps to prevent this situation. The pressure necessary to actuate the pressure relief valve 38 and allow system pressure to pass from line P2 to line P1 through line 42 is less than the pressure necessary to move/keep the indicator in the second position. In other words, anytime the rod side of the cylinder 19 sees full system pressure, the pressure relief valve 38 is actuated causing some pressure from line P2 to flow to tank 22, and the force of the biasing member 44 overcomes the partial system pressure in line P3 thereby moving the indicator 16 to the first position.

Figure 22:
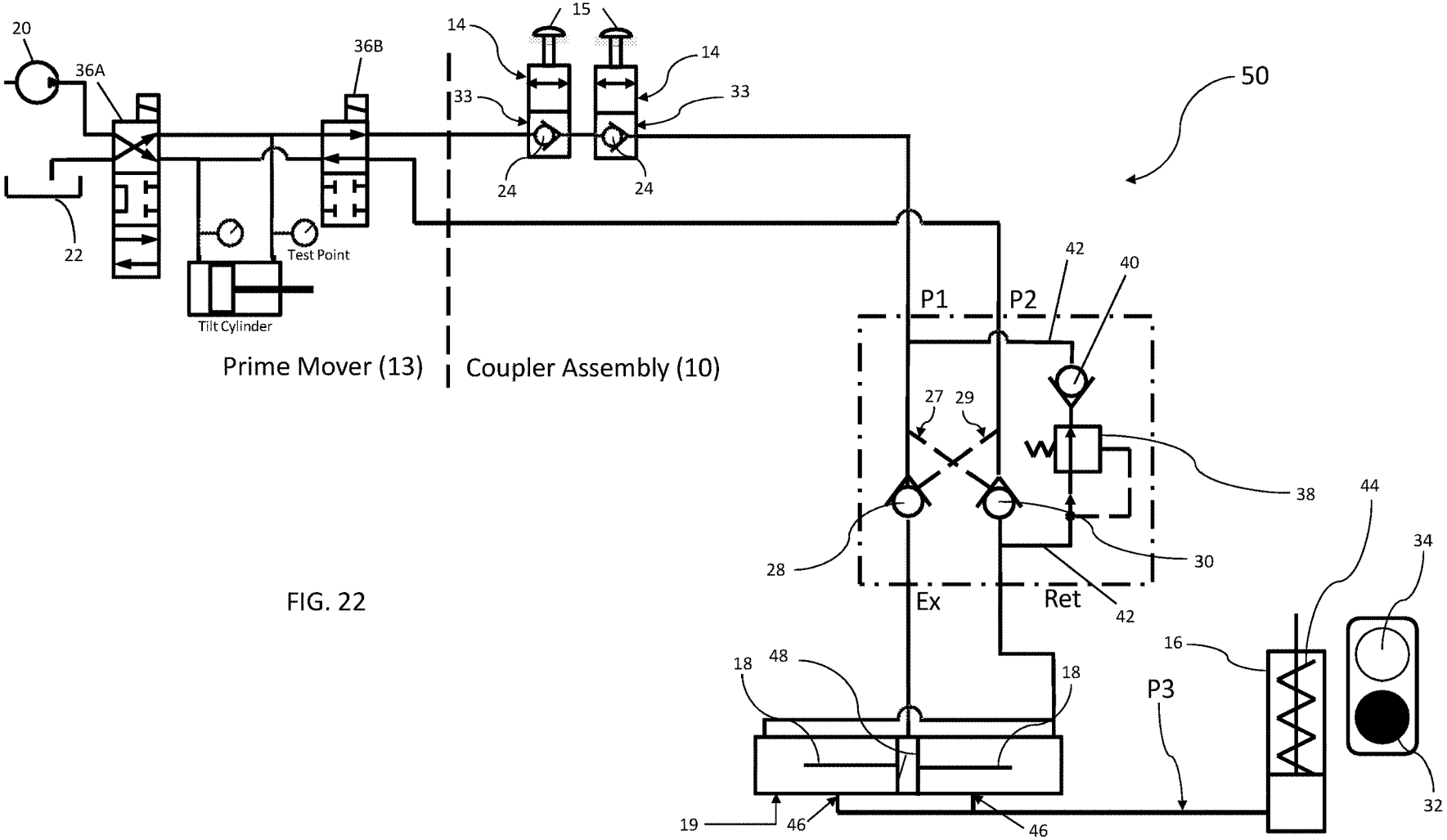
FIG. 22 is a hydraulic circuit diagram showing a thirteenth load case scenario.

FIG. 22 shows a condition similar to FIG. 21, however, in FIG. 22 there is no implement 11 attached to the coupler assembly 10. Since there is no implement 11 attached, the permissive control valve 33 in the proximity sensors 14 move to their biased/closed position wherein they allow fluid to move toward the tank 22, but not toward the locking pins 18. The pressure relief valve 38 allows fluid to pass from line P2 to line P1 toward tank 22 through line 42 without moving the indicator to the second portion 34 since the pressure necessary to actuate the pressure reliving valve 38 is less than the pressure necessary to move/keep the indicator in the second position. Pressure would continue through the pressure relief valve 38 even if the operator continued activating the retracts switch 36A, 36B.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A coupler assembly for coupling an implement to a prime mover vehicle, said coupler assembly comprising:

a hydraulic system having a first fluid flow path and a second fluid flow path, the hydraulic system configured to convey a fluid under a system pressure to a hydraulic cylinder for moving one or more locking pins between an extended position and a retracted position;

a proximity sensor in communication with the hydraulic system, the proximity sensor having an open position wherein the fluid is allowed to flow through the first fluid flow path toward the hydraulic cylinder and a closed position wherein the fluid is prevented from flowing through the first fluid flow path toward the hydraulic cylinder;

an indicator in communication with the hydraulic system, the indicator configured to indicate a first sign when not receiving system pressure and a second sign when receiving system pressure, the first sign is indicative of the locking pins not being in the extended position and the second sign is indicative of the locking pins being in the extended position.

2. The coupler assembly of claim 1 configured to receive the implement in a seated position and a non-seated position, and the proximity sensor is in the open position when the implement is received in the seated position and the closed position when the implement is received in the non-seated position.

3. The coupler assembly of claim 1 wherein the hydraulic cylinder is a double acting double rod cylinder.

4. The coupler assembly of claim 1 wherein the hydraulic system is configured to receive system pressure from a hydraulic pump.

5. The coupler assembly of claim 1 wherein the hydraulic system is configured to receive system pressure from the prime mover vehicle.

6. The coupler assembly of claim 1 wherein the hydraulic cylinder has one or more rods and one or more pistons, and the one or more locking pins are the one or more rods.

7. The coupler assembly of claim 1 wherein the proximity sensor includes a first proximity sensor and a second proximity sensor, the first proximity sensor attached to a first portion of the coupler assembly and the second proximity sensor attached to a second portion of the coupler assembly, the first proximity sensor and the second proximity sensor in communication with the hydraulic system in series.

8. The coupler assembly of claim 1 wherein the proximity sensor includes a permissive control valve operably combined with a plunger that is movable between a first position and a second position, wherein actuation of the plunger from the first position to the second position causes the proximity sensor to move from the closed position to the open position.

9. The coupler assembly of claim 1 wherein the indicator is a visual indicator configured to move between a first position to indicate the first sign and a second position to indicate the second sign, the visual indicator is biased in the first position by a biasing member providing a biasing force, wherein the hydraulic system is configured to convey a system pressure force on the visual indicator that is greater than the biasing force so the visual indicator moves from the first position to the second position when the visual indicator receives system pressure.

10. The coupler assembly of claim 1 wherein the hydraulic cylinder is in fluid communication with the indicator through a third fluid flow path and the third fluid flow path is fluid communication with the hydraulic cylinder through a junction port, wherein the hydraulic system is configured to convey the system pressure to the visual indicator through the junction port when the one or more locking pins are in the extended position but not when the one or more locking pins are in the retracted position.

11. The coupler assembly of claim 1 wherein the hydraulic system is configured to convey the system pressure to the hydraulic cylinder through the first fluid flow path and a return pressure from the hydraulic cylinder through the second fluid flow path when moving the locking pins to the extended position, and wherein the hydraulic system is configured to convey the system pressure through the second fluid flow path and the return pressure from the hydraulic cylinder through the first fluid flow path when moving the locking pins to the retracted position.

12. The coupler assembly of claim 11 further comprising a pilot operated check having a first check valve in the first fluid flow path and a second check valve in the second fluid flow path, the first check valve configured to prevent the return pressure from the hydraulic cylinder through the first fluid flow path unless unseated by system pressure supplied to the first check valve by a first pilot line receiving the system pressure from the second fluid flow path, and the second check valve configured to prevent the return pressure from the hydraulic cylinder through the second fluid flow path unless unseated by system pressure supplied to the second check valve by a second pilot line receiving the system pressure from the first fluid flow path.

13. The coupler assembly of claim 1 further comprising a pressure relief valve in fluid communication with the first fluid flow path and the second fluid flow path, the pressure relief valve having:

a. a check valve configured to allow the fluid to flow from the second fluid flow path to the first fluid flow path, but not from the first fluid flow path to the second fluid flow path; and b. an open position and a closed position, the pressure relief valve being biased in the closed position by a relief valve biasing force, wherein the hydraulic system is configured to convey a system pressure force on the pressure relief valve that is greater than the relief valve biasing force to move the pressure relief valve from the closed position to the open position when the pressure relief valve receives the system pressure from the second fluid flow path.

14. The coupler assembly of claim 1 wherein the fluid is a hydraulic fluid.

15. A coupler assembly for coupling an implement to a prime mover vehicle, the coupler assembly configured to receive the implement in a seated position and a non-seated position, said coupler assembly comprising:

a hydraulic system in fluid communication with a hydraulic cylinder, the hydraulic cylinder configured to move one or more locking pins between an extended position and a retracted position;

wherein the hydraulic system has a first fluid flow path configured to convey a fluid under a system pressure to the hydraulic cylinder for moving the one or more locking pins toward the extended position and a second fluid flow path configured to convey a return pressure away from the hydraulic cylinder as the one or more locking pins move toward the extended position;

a proximity sensor in communication with the hydraulic system, the proximity sensor configured to allow the system pressure through the first fluid flow path toward the hydraulic cylinder when the implement is received in the seated position, and prevent the system pressure from flowing through the first fluid flow path toward the hydraulic cylinder when the implement is received in the non-seated position;

an indicator in communication with the hydraulic system, the indicator configured to move from a first position to a second position when the system pressure is sensed by the indicator, the first position is indicative of the one or more locking pins not being in the extended position and the second position is indicative of the one or more locking pins being in the extended position.

16. The coupler assembly of claim 15 wherein a third fluid flow path is combined with the hydraulic cylinder at a junction port, and wherein the hydraulic system is configured to convey the system pressure from the first fluid flow path through the junction port when the one or more locking pins are in the extended position.

17. The coupler assembly of claim 16 wherein the hydraulic cylinder has a piston movable between a first side of the junction port and a second side of the junction port, and wherein the hydraulic system is configured to convey the system pressure from the first fluid flow path through the junction port when the piston is on the second side of the junction port but not when the piston is on the first side of the junction port.

18. A coupler assembly for coupling an implement to a prime mover vehicle, said coupler assembly comprising:

a hydraulic system in fluid communication with a hydraulic cylinder having a piston with a rod side and a piston side, the hydraulic cylinder configured to move a first locking pin and a second locking pin between an extended position and a retracted position;

wherein the hydraulic system has a first fluid flow path for conveying a fluid under a system pressure to the piston side of the piston for moving the first and second locking pins toward the extended position and a second fluid flow path for conveying the fluid under the system pressure to the rod side of the piston for moving the first and second locking pins toward the retracted position;

a first proximity sensor and a second proximity sensor, the proximity sensors in communication with the first fluid flow path in series, both proximity sensors having a plunger configured to move a permissive control valve between an open position and a closed position, in the open position the permissive control valve is configured to allow the system pressure to flow through the first fluid flow path toward the hydraulic cylinder to move the first and second locking pins toward the extended position, in the closed position the permissive control valve is configured to prevent the system pressure from flowing through the first fluid flow path toward the hydraulic cylinder, the permissive control valve biased in the closed position;

a visual indicator in communication with the hydraulic cylinder through a third fluid flow path of the hydraulic system, the visual indicator movable between a first position and a second position and is biased in the first position by a biasing member providing a biasing force, wherein the hydraulic system is configured to convey a system pressure force that is greater than the visual indicator biasing force so the visual indicator is configured to move from the first position to the second position when system pressure is received through the third flow path, the first position is indicative of the first and second locking pins not being in the extended position and the second position is indicative of the first and second locking pins being in the extended position.

19. The coupler assembly of claim 18 wherein the hydraulic cylinder is connected to the third fluid flow path at a junction port, the junction port positioned on the hydraulic cylinder to receive the system pressure when the first and second locking pins are in the extended position.

20. The coupler assembly of claim 18 wherein the hydraulic cylinder is connected to the third fluid flow path at a junction port, the junction port positioned on the hydraulic cylinder to receive the system pressure from the first fluid flow path on the piston side but not the rod side.

21. The coupler assembly of claim 18 further comprising a pressure relief valve in fluid communication with the first fluid flow path and the second fluid flow path, the pressure relief valve having:

a. a check valve configured to allow fluid to flow from the second fluid flow path to the first fluid flow path, but not from the first fluid flow path to the second fluid flow path; and b. an open position and a closed position, the pressure relief valve being biased in the closed position by a relief valve biasing force, wherein the hydraulic system is configured to convey a system pressure force on the pressure relief valve that is greater than the relief valve biasing force to move the pressure relief valve from the closed position to the open position when the pressure relief valve receives system pressure.

22. The coupler assembly of claim 18 further comprising a pilot operated check having a first check valve in the first fluid flow path and a second check valve in the second fluid flow path, the first check valve configured to prevent the return pressure from the hydraulic cylinder through the first fluid flow path unless unseated by the system pressure supplied to the first check valve by a first pilot line receiving the system pressure from the second fluid flow path, and the second check valve configured to prevent the return pressure from the hydraulic cylinder through the second fluid flow path unless unseated by the system pressure supplied to the second check valve by a second pilot line receiving system pressure from the first fluid flow path.

23. The coupler assembly of claim 18 configured to receive the implement in a seated position and a non-seated position, and the permissive control valve of each proximity sensor is in the open position when the implement is received in the seated position and is in the closed position when the implement is received in the non-seated position.

* * * * *